US009069271B2

(12) United States Patent
Shu et al.

(10) Patent No.: US 9,069,271 B2
(45) Date of Patent: Jun. 30, 2015

(54) IMAGE FORMING APPARATUS AND METHOD, AND TONER, DEVELOPER AND PROCESS CARTRIDGE FOR FORMING IMAGE

(75) Inventors: Hyo Shu, Shizuoka (JP); Hiroki Ishii, Kanagawa (JP); Wakana Itoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 11 days.

(21) Appl. No.: 13/369,564

(22) Filed: Feb. 9, 2012

(65) Prior Publication Data

US 2012/0214095 A1 Aug. 23, 2012

(30) Foreign Application Priority Data

Feb. 23, 2011 (JP) ..... 2011-037210

(51) Int. Cl.

*G03G 15/20* (2006.01)
*G03G 9/08* (2006.01)
*G03G 9/087* (2006.01)

(52) U.S. Cl.

CPC ..... *G03G 9/0821* (2013.01); *G03G 9/0825* (2013.01); *G03G 9/08755* (2013.01); *G03G 9/08797* (2013.01); *G03G 15/2057* (2013.01)

(58) Field of Classification Search

CPC ..... G03G 2221/1639; G03G 15/2064; G03G 15/2071; G03G 21/007; G03G 21/0011; G03G 21/10
USPC ..... 399/122, 123
See application file for complete search history.

(56) References Cited

U.S. PATENT DOCUMENTS

| | | | |
|---|---|---|---|
| 6,593,048 | B2 | 7/2003 | Sasaki et al. |
| 6,667,141 | B2 | 12/2003 | Iwamoto et al. |
| 6,699,632 | B2 | 3/2004 | Shu et al. |
| 6,790,575 | B2 | 9/2004 | Sasaki et al. |
| 6,811,944 | B2 | 11/2004 | Higuchi et al. |

(Continued)

FOREIGN PATENT DOCUMENTS

| | | | |
|---|---|---|---|
| JP | 60090344 | A | 5/1985 |
| JP | 62063940 | A | 3/1987 |

(Continued)

OTHER PUBLICATIONS

Extended European Search Report dated Jun. 6, 2012.

(Continued)

*Primary Examiner* — Hoa V Le
(74) *Attorney, Agent, or Firm* — Harness, Dickey & Pierce, P.L.C.

(57) ABSTRACT

An image forming apparatus including an image forming device forming a toner image on a recording material, and a fixing device including an endless fixing belt feeding the recording material at a speed of 400 to 1,700 mm/sec while heating to fix the toner image thereon. The fixing belt has a rubber layer located on a substrate and having thickness of 400 μm to 700 μm, and a fluorine-containing resin layer located on the rubber layer and having thickness of 2 μm to 20 μm. The toner includes a release agent including a microcrystalline wax and/or a synthetic ester wax, and a binder resin including a crystalline polyester and an amorphous polyester. The ratio (W/R) of the height (W) of the third falling peak of the crystalline polyester to the height (R) of the maximum rising peak of the amorphous polyester in the FT-IR spectrum of the toner is 0.045 to 0.850.

14 Claims, 2 Drawing Sheets

(56) References Cited

U.S. PATENT DOCUMENTS

| | | | | |
|---|---|---|---|---|
| 6,813,461 | B2 | 11/2004 | Higuchi et al. | |
| 6,835,517 | B2 | 12/2004 | Kondo et al. | |
| 6,856,781 | B2 | 2/2005 | Matsuda et al. | |
| 6,898,406 | B2 | 5/2005 | Suzuki et al. | |
| 6,911,289 | B2 | 6/2005 | Higuchi et al. | |
| 6,924,073 | B2 | 8/2005 | Higuchi et al. | |
| 6,934,484 | B2 | 8/2005 | Suzuki et al. | |
| 7,125,638 | B2 | 10/2006 | Suzuki et al. | |
| 7,162,187 | B2 | 1/2007 | Koichi et al. | |
| 7,163,774 | B2 | 1/2007 | Shiraishi et al. | |
| 7,177,555 | B2 | 2/2007 | Shu et al. | |
| 7,183,029 | B2 | 2/2007 | Masuda et al. | |
| 7,217,485 | B2 | 5/2007 | Hasegawa et al. | |
| 7,273,688 | B2 | 9/2007 | Suzuki et al. | |
| 7,515,860 | B2 | 4/2009 | Suzuki et al. | |
| 7,522,857 | B2 | 4/2009 | Hasegawa et al. | |
| 7,548,349 | B2 | 6/2009 | Koichi et al. | |
| 7,901,861 | B2 | 3/2011 | Shitara et al. | |
| 7,985,518 | B2 | 7/2011 | Shu et al. | |
| 8,007,976 | B2 | 8/2011 | Sugiura et al. | |
| 8,012,659 | B2 | 9/2011 | Shu et al. | |
| 8,034,523 | B2 | 10/2011 | Hasegawa et al. | |
| 2002/0081513 | A1 | 6/2002 | Higuchi et al. | |
| 2002/0090562 | A1 | 7/2002 | Sasaki et al. | |
| 2002/0102486 | A1 | 8/2002 | Higuchi et al. | |
| 2002/0155368 | A1 | 10/2002 | Iwamoto et al. | |
| 2002/0159797 | A1 | 10/2002 | Matsuda et al. | |
| 2003/0073021 | A1 | 4/2003 | Sasaki et al. | |
| 2003/0082472 | A1 | 5/2003 | Kondo et al. | |
| 2003/0129518 | A1* | 7/2003 | Sawada et al. | 430/109.4 |
| 2003/0152403 | A1 | 8/2003 | Suzuki et al. | |
| 2003/0165760 | A1 | 9/2003 | Higuchi et al. | |
| 2004/0076443 | A1 | 4/2004 | Suzuki et al. | |
| 2004/0146309 | A1 | 7/2004 | Shu et al. | |
| 2004/0166428 | A1 | 8/2004 | Higuchi et al. | |
| 2004/0166429 | A1 | 8/2004 | Higuchi et al. | |
| 2004/0234879 | A1 | 11/2004 | Hasegawa et al. | |
| 2005/0025535 | A1 | 2/2005 | Koichi et al. | |
| 2005/0030595 | A1 | 2/2005 | Koichi et al. | |
| 2005/0042534 | A1* | 2/2005 | Tanaka et al. | 430/108.4 |
| 2005/0064310 | A1 | 3/2005 | Masuda et al. | |
| 2005/0208403 | A1 | 9/2005 | Shu et al. | |
| 2006/0051692 | A1 | 3/2006 | Hasegawa et al. | |
| 2006/0057484 | A1* | 3/2006 | Tsurumi et al. | 430/108.8 |
| 2006/0063089 | A1* | 3/2006 | Tanaka et al. | 430/110.3 |
| 2006/0068306 | A1 | 3/2006 | Shu et al. | |
| 2006/0093943 | A1 | 5/2006 | Shu et al. | |
| 2006/0216624 | A1* | 9/2006 | Ueda et al. | 430/108.4 |
| 2006/0240350 | A1 | 10/2006 | Shu et al. | |
| 2006/0275688 | A1 | 12/2006 | Suzuki et al. | |
| 2007/0059067 | A1* | 3/2007 | Tanaka et al. | 399/346 |
| 2007/0141498 | A1* | 6/2007 | Umehara | 430/108.21 |
| 2007/0184377 | A1 | 8/2007 | Shu et al. | |
| 2007/0218386 | A1* | 9/2007 | Suzuki et al. | 430/108.4 |
| 2007/0218396 | A1* | 9/2007 | Tomita | 430/123.52 |
| 2007/0281237 | A1* | 12/2007 | Iwamoto et al. | 430/123.5 |
| 2007/0286652 | A1 | 12/2007 | Suzuki et al. | |
| 2009/0075195 | A1 | 3/2009 | Shu et al. | |
| 2009/0123857 | A1 | 5/2009 | Shu et al. | |
| 2009/0142677 | A1 | 6/2009 | Shitara et al. | |
| 2009/0155706 | A1 | 6/2009 | Shu et al. | |
| 2010/0067958 | A1 | 3/2010 | Kishida et al. | |
| 2010/0068644 | A1 | 3/2010 | Nakajima et al. | |
| 2010/0136471 | A1 | 6/2010 | Yamada et al. | |
| 2010/0196065 | A1* | 8/2010 | Matsuki et al. | 399/329 |
| 2011/0002719 | A1 | 1/2011 | Shu et al. | |
| 2011/0033794 | A1 | 2/2011 | Watanabe et al. | |
| 2011/0091245 | A1 | 4/2011 | Shitara et al. | |
| 2011/0129773 | A1 | 6/2011 | Shu et al. | |
| 2011/0165508 | A1 | 7/2011 | Nakayama et al. | |
| 2011/0182596 | A1 | 7/2011 | Ishii | |
| 2011/0188904 | A1* | 8/2011 | Kageyama et al. | 399/323 |
| 2011/0223532 | A1 | 9/2011 | Sugimoto et al. | |
| 2011/0268474 | A1 | 11/2011 | Shu et al. | |
| 2012/0014714 | A1 | 1/2012 | Shu | |
| 2012/0058425 | A1 | 3/2012 | Shu | |

FOREIGN PATENT DOCUMENTS

| | | | |
|---|---|---|---|
| JP | 64015755 | A | 1/1989 |
| JP | 02082267 | A | 3/1990 |
| JP | 03041470 | A | 2/1991 |
| JP | 03229264 | A | 10/1991 |
| JP | 08152735 | A | 6/1996 |
| JP | 11305486 | A | 11/1999 |
| JP | 2002214833 | A | 7/2002 |
| JP | 2005338814 | A | 12/2005 |
| JP | 2006336668 | A | 12/2006 |
| JP | 2007241241 | A | 9/2007 |
| JP | 2009020269 | A | 1/2009 |
| JP | 2010243905 | A | 10/2010 |

OTHER PUBLICATIONS

Abstract of JP 2005-338814 published Dec. 8, 2005.
Abstract of JP 2007-241241 published Sep. 20, 2007.
Abstract of JP 2009-020269 published Jan. 29, 2009.
Abstract of JP 2010-243905 published Oct. 28, 2010.
Abstract of JP 2002-214833 published Jul. 31, 2002.
Abstract of JP 2006-336668 published Dec. 14, 2006.
Abstract of JP 08-152735 published Jun. 11, 1996.
Abstract of JP 11-305486 published Nov. 5, 1999.
Abstract of JP 03-229264 published Oct. 11, 1991.
Abstract of JP 03-041470 published Feb. 21, 1991.
Abstract of JP 02-082267 published Mar. 22, 1990.
Abstract of JP 64-015755 published Jan. 19, 1989.
Abstract of JP 62-63940 published Mar. 20, 1987.
Abstract of JP 60-090344 published May 21, 1985.

* cited by examiner

IMAGE FORMING APPARATUS AND METHOD, AND TONER, DEVELOPER AND PROCESS CARTRIDGE FOR FORMING IMAGE

CROSS-REFERENCE TO RELATED APPLICATIONS

This patent application is based on and claims priority pursuant to 35 U.S.C. §119 to Japanese Patent Application No. 2011-037210, filed on Feb. 23, 2011 in the Japan Patent Office, the entire disclosure of which is hereby incorporated herein by reference.

FIELD OF THE INVENTION

The present invention relates to an image forming apparatus and an image forming method. In addition, the present invention also relates to a toner, a developer, and a process cartridge for use in forming images.

BACKGROUND OF THE INVENTION

Recently, a need exists for an electrophotographic image forming apparatus such as copiers, printers and facsimiles, which can produce high quality images at a high speed. In order to fulfill such a need, high speed image forming apparatuses capable of forming images at a speed of from 400 mm/sec to 1,700 mm/sec have been marketed.

However, when such high speed image formation is performed, image qualities tend to deteriorate, and in particular images having uneven glossiness tend to be formed. The reason therefor is considered to be that when high speed image formation is performed, the quantity of heat applied to fix toner images decreases, thereby making it impossible for a wax included in the toner to evenly exude from the inside of the toner. When the glossiness of a color image formed in a recording sheet varies, a serious quality problem in that the color tone, image density and color reproducibility of the image vary depending on the position of the image in the recording material sheet occurs.

Therefore, there is a need for producing images at a high speed while preventing the uneven glossiness problem. In order to fulfill the need, it will be necessary to efficiently transfer heat from a fixing device to a toner image while allowing the release agent included in the toner of the toner image to exude evenly and rapidly from the inside of the toner, so that the release agent is present on the surface of the toner image after the toner image is fixed.

In attempting to fulfill the need, a technique in that the fixing temperature is increased has been conventionally used. However, since the technique has drawbacks such that the inner temperature of the image forming apparatus seriously increases, the lives of members of the fixing device are shortened, and energy consumption of the image forming apparatus seriously increases (i.e., energy saving cannot be made), the technique is not proper.

Therefore, there is a need for a toner having such a good fixing property as to be able to be used for such high speed image formation and high speed fixation even when the fixing heat energy is relatively low.

There have been various proposals for toner in which a release agent included in the toner can easily exude from the inside of the toner.

For example, a technique in that the thermal property of a resin used for a toner is controlled to enhance the fixing property of the toner. However, when a resin having a low glass transition temperature is used for a toner, the high temperature preservability of the toner and the strength of fixed toner images tend to deteriorate. When a resin, which has a relatively low molecular weight and has a low softening point ($F_{1/2}$ temperature), is used for a toner, a hot offset problem in that toner images are adhered to a fixing member, and/or a problem in that the glossiness of images of the toner increases to an extent such that it becomes difficult to control the glossiness of the toner images, are caused. Thus, until now, it is difficult to prepare toner which has a good combination of low temperature fixability, high temperature preservability and hot offset resistance by controlling the thermal property of the resin included in the toner.

There are several proposals in which polyester resins, which have relatively good low temperature fixability compared to styrene-acrylic resins which have been conventionally used as binder resins of toner, are used for toner. In addition, there are several proposals in which a specific non-olefin crystalline polymer, which can sharply melt at the glass transition temperature thereof, is used as a binder resin of toner. However, the molecular structure and molecular weight of the polymer are not investigated, and therefore exudation of a release agent from the inside of the toner is not optimized.

Further, in attempting to impart a good combination of low temperature fixability and high temperature preservability to toner, there are proposals in which a crystalline polyester resin and a non-crystalline polyester resin are used as binder resins of toner so as to achieve a sea-island structure in the toner, and proposals in which a resin including THF-insoluble components having a maximum endothermic peak in a specific temperature range in a differential scanning calorimetry (DSC) curve is used as a binder resin of toner. However, release agents included in the toners do not sufficiently exude fro the inside of the toners.

Furthermore, toners including a crystalline polyester in a relatively large amount have been proposed. When such toners are used for high speed image forming apparatuses, a toner filming problem in that a film of the toners is formed on an image bearing member, thereby deteriorating the image quality is often caused.

Conventional image forming apparatuses typically use a fixing device which has a fixing member (such as rollers and belts) and a pressing member and in which a recording material bearing a toner image thereon is fed through the nip between the heated fixing member and the pressing member to fix the toner image on the recording material. In this regard, the fixing member typically has a structure such that a heat storage layer made of a material having a high heat capacity and a high heat transportability is formed on a substrate, and a release layer is formed on the heat storage layer as the outermost layer. However, the materials used for the layers and properties of the materials are not optimized to an extent such that the uneven glossiness problem specific to high speed image forming apparatuses is solved by the image forming apparatuses.

Thus, the uneven glossiness problem is not yet solved by conventional techniques concerning toner and image forming apparatus.

For these reasons, the present inventor recognized that there is a need for an image forming apparatus which can produce high quality images at a relatively high speed without causing the uneven glossiness problem.

BRIEF SUMMARY OF THE INVENTION

This patent specification describes a novel image forming apparatus, one embodiment of which has a system speed of from 400 to 1,700 mm/sec and includes an image forming device to form an image of a toner on a recording material, and a fixing device including an endless fixing belt to feed and heat the recording material bearing the toner image thereon to fix the toner image on the recording material. The fixing belt has at least a substrate, a rubber layer located on the substrate and having a thickness of from 400 μm to 700 μm, and a fluorine-containing resin layer located on the rubber layer and having a thickness of from 2 μm to 20 μm. The toner includes at least a release agent including at least one of a microcrystalline wax and a synthetic ester wax, and a binder resin including at least a crystalline polyester resin and an amorphous polyester resin. The toner satisfies a relation, $0.045 \leq W/R \leq 0.850$, wherein W represents the height of the third falling peak specific to the crystalline polyester resin in a Fourier transform infrared spectroscopy (FT-IR) spectrum obtained by subjecting the toner to FT-IR using a KBr pellet method, and R represents the height of the maximum rising peak specific to the amorphous polyester resin in the FT-IR spectrum.

This patent specification further describes a novel image forming method, one embodiment of which includes forming an image of the above-mentioned toner on a recoding material, and feeding the recording material bearing the toner image thereon using the above-mentioned endless fixing belt to feed the recording material at a speed of from 400 to 1,700 mm/sec while heating the recording material to fix the toner image on the recording material.

This patent specification further describes a novel toner, one embodiment of which includes at least a release agent including at least one of a microcrystalline wax and a synthetic ester wax, and a binder resin including at least a crystalline polyester resin and an amorphous polyester resin. The toner satisfies the above-mentioned relation, $0.045 \leq W/R \leq 0.850$.

This patent specification further describes a novel two-component developer, one embodiment of which includes the above-mentioned toner and a carrier to carry the toner. The above-mentioned toner can be used as a one-component developer.

This patent specification further describes a novel process cartridge, one embodiment of which includes an image bearing member to bear an electrostatic latent image thereon, and a developing device to develop the electrostatic latent image with the above-mentioned toner to form a toner image thereon. In addition, the process cartridge can further include another device such as a charger to charge the surface of the image bearing member, and/or a cleaner to clean the surface of the image forming apparatus.

BRIEF DESCRIPTION OF THE SEVERAL VIEWS OF THE DRAWINGS

A more complete appreciation of aspects of the invention and many of the attendant advantage thereof will be readily obtained as the same become better understood by reference to the following detailed description when considered in connection with the accompanying drawings, wherein.

DETAILED DESCRIPTION OF THE INVENTION

Figure 1:
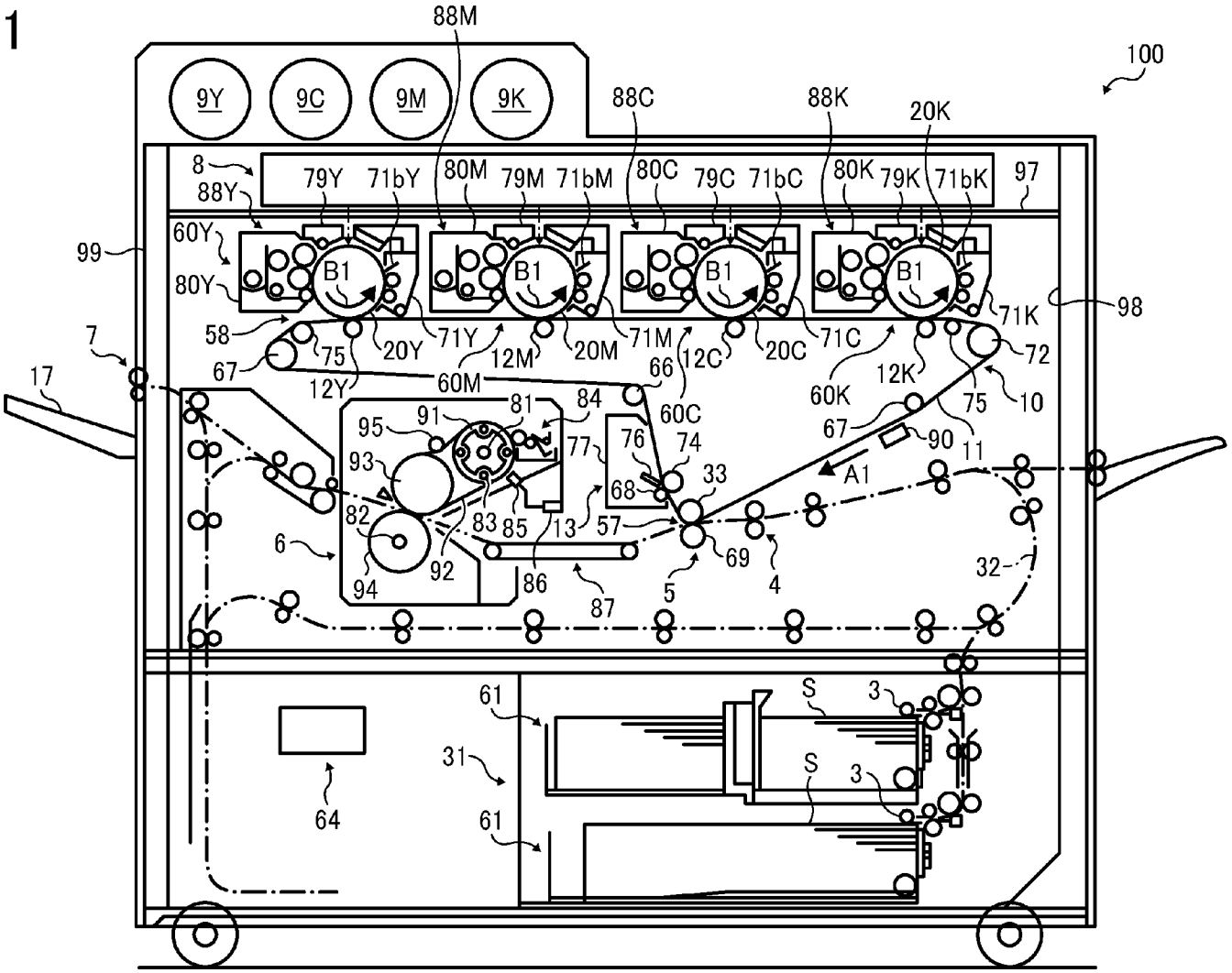
FIG. 1 is a schematic view illustrating an example of the image forming apparatus of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, example embodiments of the present patent application are described.

Initially the image forming apparatus of the present invention will be described by reference to FIG. 1.

An image forming apparatus 100 illustrated in FIG. 1 is a color laser printer, but is not limited thereto, and may be another type of printer, or a facsimile, a copier, a multifunctional product having copier, facsimile and printer functions, or the like image forming apparatus. The image forming apparatus 100 performs an image forming processing according to images signals, which correspond to image information of an image to be formed and which are sent to the image forming apparatus from outside. The image forming apparatus can form images on various recording material sheets such as plain paper sheets for use in copying and printing, overhead projection (OHP) sheets, cards, post cards, envelops, and the like.

The image forming apparatus includes photoreceptors 20Y, 20M, 20C and 20K, which serve as a first image bearing member and which are arranged in parallel (i.e., have a tandem structure) to form yellow, magenta, cyan and black toner images thereon, respectively according to image signals corresponding to yellow, magenta, cyan and black color images obtained by subjecting an image to be formed to color separation.

The photoreceptors 20Y, 20M, 20C and 20K (hereinafter sometimes referred to as photoreceptors 20) are rotatably supported by a frame of a main body 99 of the image forming apparatus 100, and are arranged in this order relative to a rotation direction A1 of an intermediate transfer belt 11 serving as a second image bearing member. In this regard, the suffixes Y, M, C and K represent that the members having the suffixes at the ends of the reference numbers thereof are used for forming yellow, magenta, cyan and black color images, and are sometimes omitted.

The photoreceptors 20Y, 20M, 20C and 20K are respectively set in yellow, magenta, cyan and black image forming units 60Y, 60M, 60C and 60K, which form yellow, magenta, cyan and black color images, respectively.

The photoreceptors 20 are located in substantially the center of the main body 99 while facing the outer surface (i.e., image bearing surface) of the intermediate transfer belt 11.

The intermediate transfer belt 11 rotates in the direction A1 while facing the photoreceptors 20. Yellow, magenta, cyan and black color toner images respectively formed on the photoreceptors 20Y, 20M, 20C and 20K are transferred onto the outer surface of the intermediate transfer belts 11 so as to be overlaid, resulting in formation of a combined color toner image on the surface of the intermediate transfer belts 11. The combined color toner image is then transferred onto a recording material sheet S. Thus, this image forming apparatus 100 is an intermediate transfer type image forming apparatus.

The upper portion of the intermediate transfer belt 11, which faces the photoreceptors 20, constitutes a primary transfer portion 58 to which the yellow, magenta, cyan and black color toner images are transferred.

Primary transfer rollers 12Y, 12M, 12C and 12K are provided so as to be contacted with the backside of the intermediate transfer belt 11 while facing the respective photoreceptors 20Y, 20M, 20C and 20K, and apply a voltage to the intermediate transfer belt 11 to transfer the yellow, magenta, cyan and black color toner images one by one to the surface of the intermediate transfer belt 11, which moves in the direction A1, so that the yellow, magenta, cyan and black color toner images are overlaid thereon, resulting in formation of a combined color toner image on the intermediate transfer belt 11.

The intermediate transfer belt 11 has a multilayer structure such that a coat layer having a smooth surface is formed on a base layer made of a material having a low elongation rate. Specific examples of the material constituting the base layer include fluorine-containing resins, PVC sheets, polyimide resins, and the like, and specific examples of the material constituting the coat layer include fluorine-containing resins.

The image forming apparatus 100 includes, in the main body 99, an intermediate transfer unit 10, which serves as an intermediate transfer device and which includes the intermediate transfer belt 11, a secondary transfer device 5 provided at a location so as to face a lower portion of the intermediate transfer belt 11, and an optical scanning device 8 serving as an optical writing device (i.e., an irradiator, or an electrostatic latent image forming device) and facing the image forming units 60.

In addition, the image forming apparatus 100 includes, in the main body 99, a sheet feeder 61, which has plural sheet cassettes capable of storing multiple sheets S of the recording material and which feeds the recording material sheet S toward a secondary transfer portion 57, a pair of registration rollers 4 to timely feed the recording material sheet S toward the secondary transfer portion 57 so that the combined color toner image on the intermediate transfer belt 11 is transferred on a proper portion of the recording material sheet S at the secondary transfer portion 57, and a sensor to detect that the front edge of the recording material sheet S reaches the pair of registration rollers 4.

In this image forming apparatus 100, the image forming units 60, the intermediate transfer unit 10, the secondary transfer device 5, the optical scanning device 8, and the sheet feeder 61 serve as an image forming device to form a toner image on the recording material sheet S. The image forming device is not limited thereto, and any devices capable of forming a toner image on a recording material can be used as the image forming device.

Further, the image forming apparatus 100 includes, in the main body 99, a fixing device 6, which is a belt-fixing type fixing device and which fixes the combined toner image on the recording material S, a belt feeder 87 to feed the recording material sheet S bearing the combined toner image thereon to the fixing device 6, a pair of discharging rollers 7 to discharge the recording material sheet S bearing a fixed toner image thereon from the main body 99, a copy tray 17 on which the discharged recording material sheet S is stacked, and toner bottles 9Y, 9M, 9C and 9K containing yellow, magenta, cyan and black toners, respectively.

The image forming apparatus further includes an optical scanning device support frame 97 on which the optical scanning device 8 is fastened, a side plate 98 to which the optical scanning device support frame 97 is fixed, driving devices to respectively drive the photoreceptors 20Y, 20M, 20C and 20K so as to rotate, and a controller 64 which includes a CPU and a memory to control all the operations of the image forming apparatus 100.

The intermediate transfer unit 10 includes not only the intermediate transfer belt 11, but also the primary transfer rollers 12Y, 12M, 12C and 12K serving as primary transfer bias rollers, a driving roller 72 around which the intermediate transfer belt 11 is looped and which drives the intermediate transfer belt 11 to rotate, a first tension roller 74 which keeps tension on the intermediate transfer belt 11 and which is opposed to a cleaning blade 76, other tension rollers 33, 66, 67 and 75 which keep tension on the intermediate transfer belt 11 together with the driving roller 72 and the first tension roller 74, and a belt cleaner 13 to clean the surface of the intermediate transfer belt 11.

The intermediate transfer unit 10 further includes a driving device to drive the driving roller 72 to rotate, and a bias applicator to apply a primary transfer bias to the primary transfer rollers 12.

The tension rollers 74, 33, 66, 67 and 75 are driven rollers, which are driven by the intermediate transfer belt 11, which is rotated by the driving roller 72. The primary transfer rollers 12Y, 12M, 12C and 12*k* press the backside of the intermediate transfer belt 11 toward the photoreceptor drums 20Y, 20M, 20C and 20K, respectively, to form primary transfer nips between the surfaces of the photoreceptors 20 and the outer surface of the upper portion of the intermediate transfer belt 11 supported by the two tension rollers 75 and 75. The tension rollers 75 have a function of stably maintaining the primary transfer nips.

Since the primary bias is applied by each primary transfer roller 12, a primary transfer electric field is formed at each primary transfer nip. Therefore, the color toner images formed on the photoreceptor drums 20 are primarily transferred onto the intermediate transfer belt 11 by the primary transfer electric field and the pressure applied to each primary transfer nip.

The tension roller 33 is contacted with the secondary transfer device 5 with the intermediate transfer bet 11 therebetween, thereby forming the secondary transfer portion 57. The tension roller 66 serves as a pressing member to cause a predetermined tension on the intermediate transfer belt 11 so that the secondary transfer operation is satisfactorily performed.

The belt cleaner 13 includes the cleaning blade 76 contacted with the surface of the intermediate transfer belt 11 so as to be opposed to the first tension roller 74, a brush roller 68 provided on an upstream side from the first tension roller 74 relative to the rotation direction A1 of the intermediate transfer belt 11 so as to be opposed to the first tension roller 74, and a case 77 containing the cleaning blade 76 and the brush roller 68 therein.

The belt cleaner 13 remove foreign materials (such as residual toner particles) remaining on the surface of the intermediate transfer belt 11 using the brush roller 68 and the cleaning blade 76, so that the surface is satisfactorily cleaned.

In this example of the image forming apparatus, the intermediate transfer belt 11 is rotated at a linear speed of 450 mm/sec by controlling the driving system. However, the speed is not limited thereto, and can be set to any speed of from 400 mm/sec to 1700 mm/sec. Thus, the image forming apparatus 100 is an ultra high speed image forming apparatus, and can produce A-4 size copies at a speed of not less than 70 cpm (copies per minute).

The sheet feeder 61 is a multi-step sheet feeder capable of accommodating a stack of recording material sheets S, and has a paper bank 31 including multiple cassettes and located at the bottom of the main body 99.

The sheet feeder 61 has a sheet feeding roller 3 pressed to an uppermost sheet of the stack of recording material sheets S. When the sheet feeding roller 3 is rotated counterclockwise at a predetermined time, the uppermost sheet S is fed toward the pair of registration rollers 4.

When the recording material sheet S fed by the sheet feeder 61 reaches the pair of registration rollers 4 via a passage 32, the sheet S is pinched by the registration rollers 4. Thereafter, the pair of registration rollers 4 feeds the sheet S toward the secondary transfer portion 57.

The secondary transfer device 5 is provided so as to be opposed to the tension roller 33. Since the secondary transfer roller 69 is contacted with the intermediate transfer belt 11, a nip (i.e., the secondary transfer portion 57) is formed therebetween, and therefore a toner image on the intermediate transfer belt 11 is transferred onto the recording material sheet S at the nip.

The fixing device 6 includes a first heating lamp 81 serving as a heat source, a heat roller 91 containing the first heating lamp 81 therein, a fixing roller 93, an endless fixing belt 92 which is looped around the heat roller 91 and the fixing roller 93, an auxiliary roller 95 serving as a tension roller to cause a tension on the fixing belt 92, a pressure roller 94 serving as a pressing member to press the fixing belt 92 toward the fixing roller 93, and a second heating lamp 82 serving as a heat source and provided in the pressure roller 94 to heat the pressure roller 94.

The fixing device 6 further includes a heat pipe 83 integrated with the heat roller 91, an oil applicator 84 to apply an oil (i.e., release agent) to the surface of the fixing belt 92, a thermopile 85 provided at a position so as to be opposed to the fixing belt 92, a temperature detector 86 connected with the thermopile 85 to detect the temperature of the surface of the fixing belt 92, and a driving device to rotate the fixing roller 93, thereby rotating the fixing belt 92, the heat roller 91, the auxiliary roller 95, and the pressure roller 94.

The heat roller 91, which is heated y the heating lamp 81, heats the inner surface of the fixing belt 92. The auxiliary roller 95 is contacted with the outer surface of the fixing belt 92 to tightly stretch the fixing belt.

The pressing member is not limited to the pressure roller 94, and any rotating members such as roller-form members and belt-form members can be used therefor. Each of the fixing roller 93 and the fixing belt 92 or a combination thereof can serve as a fixing member.

The fixing belt 92 has ribs on both sides thereof to prevent the fixing belt from meandering. The fixing belt 92 is rotated at a linear speed of 450 mm/sec by the fixing roller 93, which is rotated by a driving device. However, the speed is adjusted so as to be equal to the system speed of the image forming apparatus 100.

When the recording material sheet S bearing a toner image thereon is fed through the nip between the fixing belt 92 and the pressure roller 94, the toner image is fixed to the surface of the recording material sheet S by heat and pressure.

In this case, the heating lamp 81 is subjected to drive control based on the temperature detected by the temperature detector 86. Since the thermopile 85 is provided at a position so as to be opposed to the heat roller 91 with the fixing belt 92 therebetween, the temperature detector 86 is considered to be set at the position of the thermopile 85 and therefore can measure the temperature of the surface of the fixing belt 92. Therefore, the surface temperature of the fixing belt 92 can be precisely measured by the temperature detector 86. It is possible to set one or more temperature detectors other than the temperature detector 86 to detect temperatures of other portions of the fixing device 6. The fixing belt 92 will be described later in detail.

The optical scanning device 8 serving as an irradiator irradiates the surfaces of the photoreceptor drums 20Y, 20M, 20C and 20K with laser beams while deflecting and scanning the laser beams according to image information input from the outside of the image forming apparatus 100, thereby forming an electrostatic latent image on each photoreceptor drum 20. When the image forming apparatus 100 is a copier, the optical scanning device 8 irradiates an original to be copied set on a glass table of the copier, and then optically reads the image of the original if a copy switch is turned on. The optical scanning device 8 irradiates the surfaces of the photoreceptor drums 20 with laser beams according to the image information obtained from this image reading operation, thereby forming an electrostatic latent image on each photoreceptor drum 20. The irradiator is not limited to the optical scanning device 8, and for example, an irradiator, in which a LED array is set above each photoreceptor 20 so as to extend in the longitudinal direction (i.e., main scanning direction) of the photoreceptor drum 20, can also be used.

The color toners contained in the toner bottles 9Y, 9M, 9C and 9K are polymerized toners, and predetermined amounts of the toners are supplied to respective developing devices 80Y, 80M, 80C and 80K via feeding passages when requested, so that the concentrations of the toners in the developers in the developing devices 80 are controlled so as to be substantially constant.

Since the structures of the image forming units 60Y, 60M, 60C and 60K are substantially the same except that the color of the toner is different, one of the units, 60Y which includes the photoreceptor drum 20Y, will be mainly described hereinafter.

As illustrated in FIG. 1, the image forming unit 60Y includes the primary transfer roller 12Y, a cleaner 71Y to clean the surface of the photoreceptor drum 20Y, a discharger to discharge the surface of the photoreceptor drum 20Y, a charger 79Y to subject the photoreceptor drum 20Y to AC charging, and the developing device 80Y to develop an electrostatic latent image on the photoreceptor drum 20Y with a two-component developer, which is the developer of the present invention and which includes a yellow toner, which is the toner of the present invention, and a carrier, resulting in formation of a yellow toner image on the photoreceptor drum 20Y. These devices are provided around the photoreceptor drum 20Y in a rotating direction B1 of the photoreceptor drum.

The photoreceptor drum 20Y is driven by a driving device to rotate in the direction B1 at a predetermined peripheral speed.

The cleaner 71Y includes a cleaning blade 71*b* which is made of an elastic rubber and which is contacted with the surface of the photoreceptor drum 20Y from a counter direction to scrape off residual toner particles remaining on the surface of the photoreceptor drum even after the primary image transfer operation, thereby cleaning the photoreceptor drum 20Y.

The discharger includes a discharging lamp to discharge residual charges remaining on the surface of the photoreceptor drum 20Y even after the cleaning operation so that the surface potential of the photoreceptor drum 20Y is initialized.

The charger 79Y has a charging roller, which serves as a charging member and which is contacted with the surface of the photoreceptor drum 20Y, which has been subjected to the discharging operation, to evenly charge the surface of the photoreceptor drum 20Y so as to have a predetermined potential.

Since the cleaner 71Y has the elastic rubber blade, and the charger 79Y has the charging roller, the photoreceptor drum 20Y can be satisfactorily cleaned and charged.

The developing device 80Y has a developing roller, which is opposed to the photoreceptor drum 20Y and which bears thereon a developer of the present invention to supply a toner (yellow toner) of the present invention included in the developer to the surface of the photoreceptor drum 20Y in a development area. Thus, an electrostatic latent image formed on the surface of the photoreceptor drum 20Y by the optical scanning device 8 is developed by the toner, resulting in formation of a yellow toner image on the surface of the photoreceptor drum 20Y. The toner and developer will be described later in detail.

In this image forming apparatus 100, the photoreceptor drum 20, the cleaning device 71, the discharger, the charger 79, and the developing device 80 constitute a process cartridge 88, which can be detachably attachable to the image forming apparatus 100. Since such a process cartridge can be used as a replacement part, the maintainability of the image forming apparatus can be enhanced. The process cartridge of the present invention includes at least a photoreceptor (such as the photoreceptor drum 20) serving as an image bearing member to bear an electrostatic latent image thereon, and a developing device (such as the developing device 80) to develop the electrostatic latent image with a developer including the toner of the present invention. When a two-component developer including a carrier and the toner of the present invention is used for the developing device 80, the carrier (developer) can be replaced with a new carrier (new developer) by replacing the process cartridge 88 with a new process cartridge.

When signals for forming a color image are input to the image forming apparatus 100, the driving roller 72 is driven to rotate, and thereby the transfer belt 11, the first tension roller 74, and the other tension rollers 33, 66, 67 and 75 are driven to rotate while the photoreceptor drums 20 are rotated in the direction B1.

After the thus rotated photoreceptor drums 20 are charged by the respective chargers 79, the photoreceptors are irradiated with laser beams emitted by the optical scanning device 8 according to the yellow, magenta, cyan and black image information, resulting in formation of electrostatic latent images on the photoreceptor drums 20. The electrostatic latent images thus formed on the photoreceptor drums 20 are developed by the yellow, magenta, cyan and black toners in the respective two-component developers in the developing devices 80, resulting in formation of yellow, magenta, cyan and black toner images on the respective photoreceptor drums 20Y, 20M, 20C and 20K.

The yellow, magenta, cyan and black toner images formed on the respective photoreceptor drums 20 are sequentially transferred onto the intermediate transfer belt 11 by the primary transfer rollers 12 so as to be overlaid, resulting in formation of a combined color toner image on the intermediate transfer belt 11.

Meanwhile, upon receipt of signals for forming a color image (or when the copy switch is turned on in a case where the image forming apparatus 100 is a copier), one of the sheet feeders 61 are selected and the sheet feeding roller 3 of the selected sheet feeder is rotated to feed the recording material sheets S one by one toward the passage 32 while separating the sheets. The thus fed recording material sheet S is further fed by feeding rollers in the passage 32 so as to strike the pair of registration rollers 4, and is stopped once by the pair of registration rollers 4.

When the combined color toner image formed on the intermediate transfer belt 11 is moved to the secondary transfer portion 57 by rotation of the intermediate transfer belt 11, the recording material sheet S is also fed by the pair of registration rollers 4 to the secondary transfer portion 57 so that the combined color toner image is transferred onto a proper position of the recording material sheet S at the secondary transfer portion 57 by means of the nip pressure and the bias applied to the secondary transfer portion.

The recording material sheet S bearing the combined color toner image thereon is fed to the fixing device 6 by the belt feeder 87, and the combined color toner image is fixed to the recording material sheet S by the fixing device 6 upon application of heat and pressure, resulting in formation of a fixed full color toner image on the recording material sheet S. The fixation process will be described later in detail.

The recording material sheet S bearing the fixed full color toner image thereon is discharged from the main body 99 by the pair of discharging rollers 7 so as to be stacked on the copy tray 17.

After the primary transfer operation, the photoreceptor drums 20 are subjected to a cleaning operation to remove toner particles therefrom using the respective cleaners 71, followed by a discharging operation using the dischargers so as to be ready for the next image forming operation starting from a charging operation using the chargers 79.

After the secondary transfer operation (i.e., after the intermediate transfer belt 11 passes the secondary transfer portion 57), the intermediate transfer belt 11 is cleaned by the cleaning blade 76 of the belt cleaner 13 so as to be ready for the next secondary transfer operation.

Figure 2:
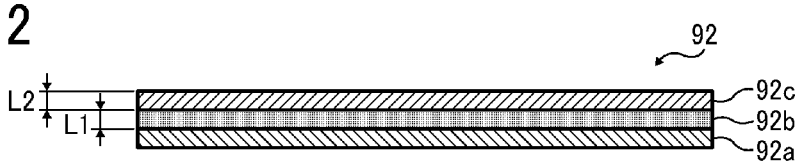
FIG. 2 is a schematic view illustrating an example of the fixing belt of the image forming apparatus illustrated in FIG. 1.

The image forming operation of the image forming apparatus 100 is performed as mentioned above. Since this image forming apparatus 100 is a high speed image forming apparatus having a system speed of from 400 mm/sec to 1700 mm/sec, it is necessary to prevent occurrence of the uneven glossiness problem mentioned above. In order to prevent occurrence of the uneven glossiness problem, the fixing belt 92 of the fixing device 6 includes at least a substrate 92*a*, a rubber layer 92*b* having a thickness L1 of from 400 μm to 750 μm, and a release layer 92*c* having a thickness of from 2 μm to 20 μm as illustrated in FIG. 2, and the toner has a specific formula and property mentioned below.

Suitable materials for use in the substrate 92*a* include heat resistant materials such as resins (e.g., polyimide resins), metals (e.g., nickel), and the like.

Since the rubber layer 92*b* serves as a heat storage layer, materials having a large heat capacity and a high heat transportability and being different from the material for use in the substrate 92*a* are preferably used for the rubber layer 92*b*. Specific examples of the materials for use in the rubber layer 92*b* include rubbers, and silicone rubbers are preferably used.

Since the release layer 92*c* is an outermost layer, and is used as a fixing surface, it is important that the layer has a good releasability. Therefore, the release layer 92*c* is preferably constituted of a fluorine-containing material, which has good releasability. In this example, the release layer 92*c* is made of a fluorine-containing resin, PFA (tetrafluoroethylene-perfluoroalkoxyethylene copolymer), and therefore the release layer has good releasability.

In order to enhance the releasability of the fixing belt 92, an oil serving as a release agent is applied to the surface of the fixing belt by the oil applicator 84. In this regard, since fluorine-containing resins (particularly PFA) have better affinity for oils than other materials, application of an oil to the release layer can impart good releasability to the release layer.

The thicknesses L1 and L2 of the rubber layer 92*b* and the release layer 92*c* will be described.

As a result of the present inventors' investigation, the thickness L1 of the rubber layer 92*b* is from 400 μm to 750 μm to impart good heat storage property to the rubber layer 92*b*. Specifically, when the thickness L1 is less than 400 μm, the rubber layer 92*b* produces an insufficient heat storage effect, thereby applying an insufficient amount heat to the toner, resulting in frequent occurrence of the uneven glossiness problem. In contrast, when the thickness L1 is greater than 750 μm, the heat inertia excessively increases, thereby deteriorating the temperature rising property of the fixing belt 92.

In contrast to the rubber layer 92*b*, the main function of the release layer 92*c* is to impart good releasability to the fixing belt 92. Therefore, the release layer can carry out the function even when the thickness L2 is less than the thickness L1. As a result of the present inventors' investigation, the thickness L2 of the release layer 92*c* is preferably from 2 μm to 20 μm. Specifically, when the thickness L2 is less than 2 μm, the release layer 92*c* has insufficient durability. In contrast, when the thickness L2 is greater than 20 μm, the heat transportability of the release layer 92*c* deteriorates, thereby often causing the uneven glossiness problem.

In the example of the fixing belt 92 illustrated in FIG. 2, the rubber layer 92*b* is formed on the substrate 92*a*, and the release layer 92*c* is formed on the rubber layer 92*b*. However, the structure is not limited thereto, and one or more layers may be formed between the substrate 92*a* and the rubber layer 92*b* and/or between the rubber layer 92*b* and the release layer 92*c* as long as the functions of the layers 92*a*, 92*b* and 92*c* can be satisfactorily carried out. The ratio (L1/L2) of the thickness L1 to the thickness L2 in FIG. 2 is not proportional to the real thickness ratio L1/L2.

Since the fixing device 6 has a compact size and a simple structure as mentioned above, the image forming apparatus 100 also has a compact size, a simple structure and low costs while producing images having good fixing property.

Next, the toner of the present invention will be described in detail.

The toner of the present invention includes at least a release agent and a binder resin. The release agent includes at least one of a microcrystalline wax and a synthetic ester wax. The binder resin includes at least a crystalline polyester resin and an amorphous polyester resin. In this regard, the ratio W/R is from 0.045 to 0.850, wherein W represents the height of the third falling peak of the Fourier transform infrared spectroscopy (FT-IR) spectrum of the crystalline polyester resin, and R represents the height of the maximum rising peak of the FT-IR spectrum of the amorphous polyester resin.

The ratio W/R will be described in detail.

The amount and content of the crystalline polyester resin present in a surface portion of toner particles can be determined from the height W of a peak of the absorption spectrum specific to the crystalline polyester resin obtained by subjecting the toner to a Fourier transform infrared spectroscopy (FT-IR) using an instrument, AVATAR 370 from Thermo Electron Corporation, and a KBr pellet method (i.e., total transmittance method). In addition, the amount and content of the amorphous polyester resin present in the surface portion of the toner particles can be determined from the height R of a peak of the absorption spectrum specific to the amorphous polyester resin. The ratio W/R is from 0.045 to 0.850, and preferably from 0.080 to 0.450.

When the ratio W/R is less than 0.045, the release agent (wax) included inside toner particles cannot easily exude therefrom, thereby often causing the uneven glossiness problem. In contrast, when the ratio W/R is greater than 0.850, the release agent (wax) excessively exudes from the inside of toner particles, thereby often contaminating the feeding rollers in the image forming apparatus, resulting in shortening of the lives of the rollers and occurrence of deficient feeding of the recording material sheet S.

The reason why a crystalline polyester resin can easily exude a wax therefrom is not yet determined but is considered to be as follows.

Specifically, a specific crystalline polyester resin is not compatible with an amorphous resin in toner particles, and is finely dispersed in the toner particles while maintaining the crystalline form. Since a specific wax, which is described below, has affinity for such a crystalline polyester resin, the wax is dispersed in the toner particles together with the crystalline polyester resin. Namely, the crystalline polyester resin is considered to serve as a dispersing agent for dispersing the wax in the toner particles. Since the toner particles have such a structure, the wax finely dispersed therein easily exudes from the inside of the toner particles when the toner particles are heated and pressed in the fixing operation, resulting in production of a releasing effect, thereby solving the uneven glossiness problem and an image surface roughening problem in that the surface of a fixed image is roughened.

It is preferable to use a microcrystalline wax and/or a synthetic ester wax as the release agent to be included in the toner of the present invention. By using such a toner together with the above-mentioned elastic fixing belt, occurrence of the uneven glossiness problem and the image surface roughening problem can be prevented even when the image forming operation is performed at such a super high speed as mentioned above.

The above-mentioned W/R ratio (i.e., the FT-IR peak ratio of the peak of a crystalline polyester resin to the peak of an amorphous polyester resin) is considered to be determined depending on the dispersing state of the crystalline polyester resin in the amorphous polyester resin. Since it is not easy to determine the crystallinity of a resin, it is preferable in the present invention that the toner formulation and the conditions (including the emulsification condition) under which the toner is prepared are optimized so that the W/R ratio falls in the range of from 0.045 to 0.850. Namely, it is a key of the present invention to optimize the toner formulation and toner preparation conditions to control the dispersing state of the crystalline polyester resin in the amorphous polyester resin in the toner.

Next, the method for determining the W/R ratio will be described.

The W/R ratio is determined by a FT-IR method in which the toner is subjected to FT-IR (Fourier transform infrared spectroscopy) using a KBr pellet method (i.e., total transmittance method), and the ratio of the strength of the peak specific to the crystalline polyester resin in the spectrum to the strength of the peak specific to the amorphous polyester resin in the spectrum is determined.

Figure 3:
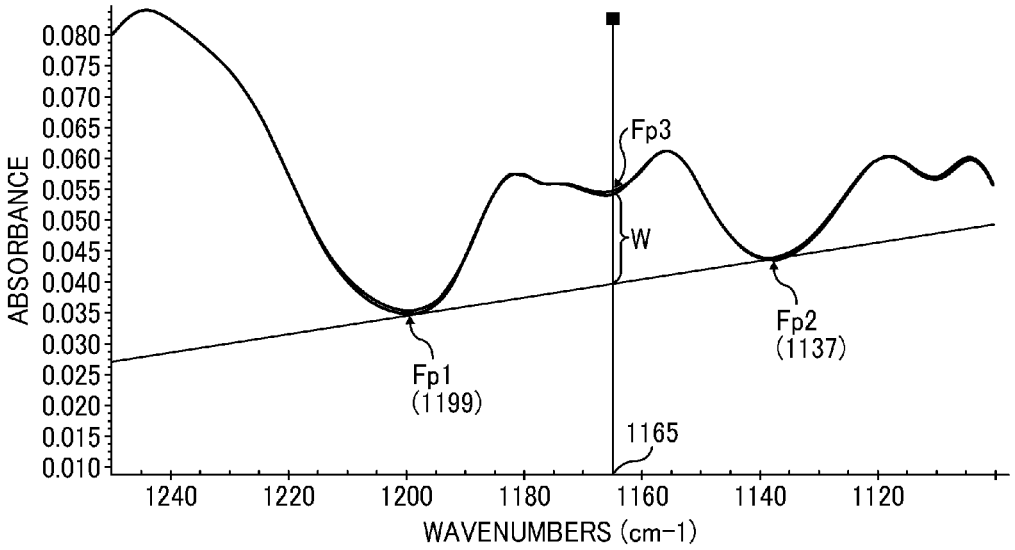
FIG. 3 is a graph illustrating FT-IR spectra of a crystalline polyester resin included in an example of the toner of the present invention when the toner is subjected to FT-IR several times.

More specifically, the peak specific to a crystalline polyester resin used for determining W is, for example, a peak observed at 1165 $cm^{-1}$ (whose base line is a line obtained by connecting a point at 1199 $cm^{-1}$ and a point at 1137 $cm^{-1}$ as illustrated in FIG. 3), and the peak specific to an amorphous polyester resin used for determining R is, for example, a peak observed at 829 $cm^{-1}$ (whose base line is a line obtained by connecting a point at 784 $cm^{-1}$ and a point at 889 $cm^{-1}$. FIG. 3 will be described later in detail. Thus, the ratio W/R can be determined. In this regard, W and R represent heights of the peaks in an absorbance curve obtained from the spectrum.

The reason why microcrystalline waxes and synthetic ester waxes are preferably used for the toner of the present invention will be described in detail.

Among microcrystalline waxes, microcrystalline waxes having the following properties are preferable.

(1) The waxes are constituted of hydrocarbons having not less than 20 carbon atoms and not greater than 80 carbon atoms, and the content of linear hydrocarbons in the hydrocarbons is not less than 55% by weight and not greater than 70% by weight; and (2) The waxes have a melting point, which is defined as the maximum endothermic peak in a differential scanning calorimetry (DSC) curve, is not lower than 65° C. and not higher than 90° C.

When the number of carbon atoms of the hydrocarbons constituting a microcrystalline wax is less than 20 or the DSC melting point is lower than 65° C., the wax excessively exudes from the inside of the toner particles in the fixing operation, thereby contaminating recording material sheet feeding members such as rollers, resulting in shortening of the lives of the members. In contrast, when the number of carbon atoms is greater than 80 or the DSC melting point is higher than 90° C., the wax hardly exudes from the inside of the toner particles in the fixing operation, thereby deteriorating the releasability of the surface of fixed toner images, resulting in occurrence of the uneven glossiness problem.

Among ester waxes, synthetic ester waxes are preferably used for the toner of the present invention, and monoester waxes prepared by using a saturated linear long chain fatty acid and a saturated linear long chain alcohol are more preferably used therefor.

Saturated linear long chain fatty acids for use in preparing synthetic ester waxes preferably have a formula $C_nH_{2n+1}COOH$ wherein n is an integer of from about 5 to about 28. Saturated linear long chain alcohols for use in preparing synthetic ester waxes preferably have a formula $C_nH_{2n+1}OH$ wherein n is an integer of from about 5 to about 28.

Specific examples of the saturated linear long chain fatty acids include capric acid, undecylic acid, lauric acid, tridecylic acid, myristic acid, pentadecylic acid, palmitic acid, heptadecanoic acid, tetradecanoic acid, stearic acid, nonadecanoic acid, aramonic acid, behenic acid, lignoceric acid, cerotic acid, heptacosanoic acid, montanic acid, and melissic acid.

Specific examples of the saturated linear long chain alcohols include amyl alcohol, hexyl alcohol, heptyl alcohol, octyl alcohol, capryl alcohol, nonyl alcohol, decyl alcohol, undecyl alcohol, layryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecane-1-ol.

These fatty acids and alcohols can include substituents such as lower alkyl groups, amono groups, and halogen atoms as long as the fatty acids and alcohols have a linear structure having not less than 5 carbon atoms and the above-mentioned effects can be produced.

The above-mentioned monoester waxes can be prepared, for example, by a method including feeding one mole of a saturated linear long chain fatty acid and two moles of a saturated linear long chain alcohol in a round bottom flask equipped with a stirrer and a condenser; adding a small amount of sulfuric acid thereto; heating the mixture for 4 hours at about 130° C. while refluxing the mixture; removing excess of the alcohol; and refining the residue using methyl ether or the like.

In addition, triester waxes synthesized from boric acid (such as boric anhydride or boron trichloride) and a saturated linear long chain alcohol can also be used as synthetic ester waxes. Such triester waxes can be prepared, for example, by a method including feeding one mole of boric anhydride and three moles of a saturated linear long chain alcohol in a round bottom flask equipped with a stirrer and a condenser; heating the mixture at a temperature not lower than 120° C. to react the components; removing excess of the alcohol; and refining the residue using an alcohol, an ether or the like.

Further, oligoester waxes synthesized from a neopentyl-form polyol, a dicarboxylic acid, and a saturated linear long chain fatty acid can also be used as synthetic ester waxes. Specific examples of the neopentyl-form polyol include neopentyl glycol, trimethylolpropane, pentaerythritol and the like. Among these compounds, pentaerythtitol is preferable because the resultant toner has good preservability.

Specific examples of such a dicalboxylic acid include saturated dicaloxylic fatty acids such as oxalic acid, malonic acid, succinic acid, glutaric acid, adipic acid, pimelic acid, suberic acid, azelaic acid, and sebacic acid, unsaturated dicaloxylic fatty acids such as maleic acid, and fumaric acid, aromatic dicarboxylic acids such as phthalic acid, isophthalic acid, and terephthalic acid, and the like. Among these dicarboxylic acids, short chain dicarboxylic fatty acids such as oxalic acid, malonic acid, maleic acid, and fumaric acid are preferable because the resultant waxes have a relatively low melting point, thereby imparting good fixing property to the toner.

Such oligoester waxes are typically synthesized by a method including feeding a neopentyl-form polyol, a dicarboxylic acid, and a saturated linear long chain fatty acid into a round bottom flask equipped with a stirrer and a condenser, adding sulfuric acid to the mixture, heating the mixture for 4 hours at about 130° C. while refluxing, and then refining the residue with methyl ether or the like.

Among ester waxes, waxes having a differential scanning calorimetric (DSC) endothermic peak at a temperature range of from 40° C. to 90° C. are preferable. As the DSC endothermic peak temperature decreases, the low temperature fixability of the resultant toner improves. However, when the DSC absorption peak temperature is lower than 40° C., the preservability of the toner tends to deteriorate. In contrast, when the DSC endothermic peak temperature is higher than 40° C., the low temperature fixability of the toner tends to deteriorate.

The content of a release agent in the toner is preferably from 1% by weight to 20% by weight based on the weight of the toner particles. When the content is less than 1% by weight, exudation of the release agent from the inside of the toner tends to deteriorate, thereby often causing the uneven glossiness problem. In contrast, when the content is greater than 20% by weight, the release agent excessively exudes from the inside of toner particles, thereby contaminating the feeding members (such as rollers) in the image forming apparatus, resulting in shortening of the lives of the feeding members and occurrence of deficient feeding of the recording material sheet S.

In this regard, the melting point of the release agent included in the toner of the present invention is defined as the temperature of a maximum endothermic peak in a DSC curve of the release agent obtained by subjecting the release agent to a differential scanning calorimetric (DSC) analysis.

The DSC maximum endothermic peak temperature of the crystalline polyester resin included in the toner is preferably from 50° C. to 150° C. When the DSC maximum endothermic peak temperature is lower than 50° C., the high temperature preservability tends to deteriorate, and a problem in that the toner aggregates and cannot be fed when being preserved at a relatively high temperature tends to occur. In contrast, when the DSC maximum endothermic peak temperature is higher than 150° C., exudation of the release agent from the inside of the toner tends to deteriorate, thereby often causing the uneven glossiness problem.

The toner particles preferably have a volume average particle diameter of from 3.0 μm to 6.0 μm. When the volume average particle diameter is less than 3.0 μm, the content of fine particles increases, thereby often causing a problem in that fine toner particles fixedly adhere to a developing sleeve. In contrast, when the volume average particle diameter is greater than 6.0 μm, the total surface area of the toner particles decreases, exudation of the release agent from the inside of the toner particles tends to deteriorate, thereby often causing the uneven glossiness problem.

The particle diameter ratio (V/N) of the volume average particle diameter (V) of the toner particles to the number average particle diameter (N) thereof is preferably from 1.05 to 1.25. When the particle diameter ratio (V/N) is less than 1.05, it is necessary to remove relatively fine particles from the toner particles to prepare a toner having a desired particle diameter distribution, thereby deteriorating the productivity of the toner. In contrast, when the particle diameter ratio (V/N) is greater than 1.25, the toner particles have a broad particle diameter distribution, and therefore exudation of the release agent from the inside of the toner particles tends to deteriorate, thereby often causing the uneven glossiness problem.

Next, the toner constituents will be described in detail.

The toner of the present invention includes a crystalline polyester resin (hereinafter referred to as a crystalline polyester (iii)).

The crystalline polyester (iii) is prepared by reacting an alcohol component with an acid component, and has a melting point.

Specific examples of the alcohol components include diols having 2 to 6 carbon atoms such as 1,4-butanediol, 1,6-hexanediol, and derivatives thereof. Specific examples of the acid components include maleic acid, fumaric acid, succinic acid, and derivatives thereof.

Among such crystalline polyester resins, resins having the following formula (I) are preferable.

$$\text{+O—CO—CR}_1\text{=CR}_2\text{—CO—O(CH}_2\text{)}_n\text{+} \quad (1)$$

wherein each of $R_1$ and $R_2$ represents a hydrogen atom or a hydrocarbon group having 1 to 20 carbon atoms, and n is a positive integer.

In order to control the crystallinity and softening point of a crystalline polyester (iii), a non-linear polyester unit may be incorporated into the crystalline polyester. Specifically, when a crystalline polyester resin (iii) is synthesized, a polyalcohol having three or more hydroxyl groups such as glycerin, and a polycarboxylic acid having three or more carboxyl groups such as trimellitic anhydride are added to a mixture of a diol component and a dicarboxylic acid component, followed by a condensation reaction, thereby synthesizing a polyester resin having a non-linear polyester unit therein.

The structure of a crystalline polyester (iii) can be determined by a solid state NMR method or the like.

As a result of the present inventors' investigation, it is found that the crystalline polyester (iii) for use in the toner of the present invention preferably has the following molecular weight properties.

Specifically, when the o-dichlorobenzene-soluble components of the crystalline polyester (iii) are subjected to gel permeation chromatography (GPC) and a molecular weight (M) distribution curve is drawn by plotting a logarithmic molecular weight (log (M)) on the horizontal axis while plotting the content (% by weight) of the component on the vertical axis, a peak is observed in a range of from 3.5 to 4.0 in log(M), the half width of the peak is not greater than 1.5, the weight average molecular weight (Mw) is from 1,000 to 6,500, the number average molecular weight (Mn) is from 500 to 2,000, and the ratio (Mw/Mn) is from 2 to 5.

The diameter (i.e., long axis diameter) of a crystalline polyester (iii) dispersed in the toner particles is preferably from 0.2 μm to 3.0 μm. When the long axis diameter of the crystalline polyester in the toner particles is controlled to fall the above-mentioned range, the wax (such as microcrystalline waxes and ester waxes) included in the toner particles can be finely dispersed therein, thereby preventing occurrence of a problem in that the wax unevenly exudes from the toner particles in the fixing operation.

The crystalline polyester (iii) included in the toner preferably has an acid value of from 8 mgKOH/g to 45 mgKOH/g, and more preferably from 20 mgKOH/g to 45 mgKOH/g. Specifically, when the acid value is not less than 8 mgKOH/g, good affinity for recording material sheets (such as papers) can be imparted to the toner, thereby enhancing the low temperature fixability of the toner. In order to impart better affinity for recording material sheets to the toner, the acid value is more preferably not less than 20 mgKOH/g. When the acid value is not greater than 45 mgKOH/g, good hot-offset resistance can be imparted to the toner.

The crystalline polyester (iii) included in the toner preferably has a hydroxyl value of from 0 mgKOH/g to 50 mgKOH/g, and more preferably from 5 mgKOH/g to 50 mgKOH/g to impart a good combination of low temperature fixability and charge properties to the toner.

The toner of the present invention optionally includes a colorant. Suitable materials for use as the colorant include known dyes and pigments. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1% to 15% by weight, and more preferably from 3% to 10% by weight of the toner.

The toner of the present invention can include a charge controlling agent. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, and the like. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of a charge controlling agent in the toner of the present invention is determined depending on the variables such as choice of binder resin, presence of additives, and dispersion method. In general, the content of a charge controlling agent is preferably from 0.1 parts to 10 parts by weight, and more preferably from 0.2 parts to 5 parts by weight, per 100 parts by weight of the binder resin included in the toner. When the content is greater than 10 parts by weight, the charge quantity of the toner excessively increases, thereby excessively increasing the electrostatic attraction between the developing roller and the toner, resulting in deterioration of fluidity and decrease of image density. When a charge controlling agent is included in the toner, a method in which the charge controlling agent is preliminarily kneaded together with a colorant master batch or a binder resin, the mixture is dissolved in a solvent, and the solution is added when other toner components such as binder resins and release agents are mixed to prepare an oil phase liquid; a method in which the charge controlling agent is directly added to a solvent together with other toner components such as binder resins and release agents to prepare an oil phase liquid; a method in which after preparing toner particles, the charge controlling agent is mixed with the toner particles to be fixedly adhered thereto, and the like method can be used.

The toner of the present invention is preferably prepared by a method including preparing an oil phase liquid in which toner components such as binder resins and release agents are dissolved or dispersed in a solvent; emulsifying or dispersing the oil phase liquid in an aqueous medium (i.e., an aqueous phase liquid); and removing the solvent to prepare toner particles. In order to enhance the fluidity, developing property, charging property, and cleaning property, external additives may be added to the thus prepared toner particles. Specific examples of such external additives include particulate inorganic materials, which preferably have an average primary particle diameter of from 5 nm to 2 μm, and more preferably from 5 nm to 500 nm. In addition, it is preferable that the specific surface area of such particulate inorganic materials measured by a BET method is from 20 to 500 $m^2/g$. The content of an external additive is preferably from 0.01% to 5% by weight, and more preferably from 0.01% to 2.0% by weight, based on the total weight of the toner.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, and the like.

In addition, particles of polymers such as polymers prepared by a soap-free emulsion polymerization or a suspension polymerization (e.g., polystyrene, and (meth)acrylic ester copolymers), polycondensation polymers such as silicone resins, benzoguanamine resins, and nylon resins, and thermosetting polymers can also be used as external additives.

It is possible to subject toner particles to a surface treatment using a fluidizer, a hydrophobizing agent, and/or the like, so that the resultant toner has a good combination of fluidity and charge property even under high humidity conditions. Specific examples of the treatment agents include silane coupling agents, silane coupling agents having a fluoroalkyl group, silylating agents, organic titanate coupling agents, aluminum coupling agents, silicone oils, modified silicone oils, and the like.

The toner of the present invention is preferably prepared by a method including the following steps:

(1) dissolving or dispersing at least a binder resin, and/or a precursor of a binder resin in an organic solvent together with a release agent to prepare a toner component liquid (i.e., an oil phase liquid);
(2) feeding the toner component liquid into an aqueous medium (i.e., an aqueous phase liquid) to prepare an emulsion or dispersion; and
(3) removing the solvent from the emulsion or dispersion to prepare toner particles.

Hereinafter an example of the method for preparing the toner of the present invention will be described, but the method for preparing the toner of the present invention is not limited thereto.

Suitable materials for use as the binder resin of the toner include polyester resins having at least an ester bond, and modified polyester resins having an ester bond and a bond other than the ester bond. In addition, precursors of modified polyester resins, which can produce modified polyester resins by being reacted, can also be used as the binder resin. Suitable precursors include polyesters prepared by reacting a compound having an active hydrogen atom with a compound having a functional group reactive with an active hydrogen atom. Specific examples thereof include polyester prepolymers having an isocyanate group (hereinafter referred to as polyester prepolymers (A)).

Such polyester prepolymers (A) are typically prepared by the following method. Specifically, a polyol (1) and a polycarboxylic acid (2) are heated to a temperature of from 150° C. to 280° C. in the presence of an esterification catalyst such as tetrabutoxy titanate and dibutyltin oxide to react the compounds. In this regard, the reaction is performed at a reduced pressure, if necessary. By removing water from the reaction product, a polyester resin having a hydroxyl group is obtained. The thus prepared polyester resin is then reacted with a polyisocyanate (3) at a temperature of from 40° C. to 140° C. to prepare a polyester prepolymer (A) having an isocyanate group (i.e., a polyester prepolymer (A)). Further, the polyester prepolymer (A) is reacted with a compound having an active hydrogen such as amines (B) at a temperature of from 0° C. to 140° C. to prepare a polyester having a urea bond (hereinafter referred to as a urea-modified polyester).

Specific examples of the polyol (1) include alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol, and hydrogenated bisphenol A); bisphenols (e.g., bisphenol A, bisphenol F, and bisphenol S); alkylene oxide adducts of alicyclic diols (e.g., adducts of an alkylene oxide (e.g., ethylene oxide, propylene oxide, and butylene oxide) with the alicyclic diols mentioned above); and alkylene oxide adducts of bisphenols (e.g., adducts of an alkylene oxide (e.g., ethylene oxide, propylene oxide and butylene oxide) with the bisphenols mentioned above). These compounds can be used alone or in combination.

Among these polyols, alkylene glycols having from 2 to 12 carbon atoms, and alkylene oxide adducts of bisphenols (e.g., ethylene oxide (2 moles) adducts of bisphenol A, propylene oxide (2 moles) adducts of bisphenol A, and propylene oxide (3 moles) adducts of bisphenol A) are preferable.

Specific examples of the polyol (1) having three or more hydroxyl groups include aliphatic polyalcohols having three or more hydroxyl groups (e.g., glycerin, trimethylol ethane, trimethylol propane, pentaerythritol, and sorbitol); polyphenols having three or more hydroxyl groups (phenol novolac, and cresol novolak); adducts of the polyphenols mentioned above with an alkylene oxide such as ethylene oxide, propylene oxide and butylene oxide; and the like. These compounds can be used alone or in combination.

Specific examples of the polycarboxylic acid (2) include alkylene dicarboxylic acids (e.g., succinic acid, adipic acid, and sebacic acid); alkenylene dicarboxylic acids (e.g., maleic acid, and fumaric acid); aromatic dicarboxylic acids (e.g., terephthalic acid, isophthalic acid, and naphthalene dicarboxylic acids); and the like. These compounds can be used alone or in combination. Among these compounds, alkenylene dicarboxylic acids having from 4 to 20 carbon atoms, and aromatic dicarboxylic acids having from 8 to 20 carbon atoms are preferably used.

Specific examples of the polycarboxylic acid (2) having three or more carboxyl groups include aromatic polycarboxylic acids having from 9 to 20 carbon atoms (e.g., trimellitic acid, and pyromellitic acid). These compounds can be used alone or in combination. When a polycarboxylic acid (2) is reacted with a polyol (1), anhydrides or lower alkyl esters (e.g., methyl esters, ethyl esters, or isopropyl esters) of the polycarboxylic acids mentioned above can also be used as the polycarboxylic acid.

Isocyanating agents are used for the polyisocyanate (3). Specific examples thereof include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Specific examples of the materials for use as the amine (B) include diamines (B1), polyamines (B2) having three or more amino groups, amino alcohols (B3), amino mercaptans (B4), amino acids (B5) and blocked amines (B6) in which the amines (B1-B5) mentioned above are blocked. These amines can be used alone or in combination.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); and the like.

Specific examples of the polyamines (B2) having three or more amino groups include diethylene triamine, triethylene tetramine, and the like. Specific examples of the amino alcohols (B3) include ethanol amine, hydroxyethyl aniline, and the like. Specific examples of the amino mercaptan (B4) include aminoethyl mercaptan, aminopropyl mercaptan, and the like. Specific examples of the amino acids (B5) include aminopropionic acid, aminocaproic acid, and the like. Specific examples of the blocked amines (B6) include ketimine compounds which are prepared by reacting one of the amines (B1-B5) mentioned above with a ketone such as acetone, methyl ethyl ketone and methyl isobutyl ketone; oxazoline compounds, and the like.

When a polyisocyanate (3) is used for isocyanating a polyester, or a prepolymer (A) is reacted with an amine (B), a solvent can be used if necessary. Specific examples of the solvent include solvents, which are not reactive with polyisocyanates, such as aromatic solvents (e.g., toluene and xylene), ketones (e.g., acetone, methyl ethyl ketone, and methyl isobutyl ketone), esters (e.g., ethyl acetate), amides (e.g., dimethylformamide and dimethylacetamide), and ethers (e.g., tetrahydrofuran).

An unmodified polyester resin (hereinafter referred to as an unmodified polyester (ii)) can be used as a binder resin. Such an unmodified polyester (ii) can be prepared by the method mentioned above for use in preparing the polyester having a hydroxyl group. The thus prepared unmodified polyester (ii) is dissolved in an organic solvent, and the solution is added to the oil phase liquid.

The aqueous medium used for the aqueous phase liquid is water or a combination of water and a solvent which can be mixed with water. Specific examples of such a solvent include alcohols (e.g., methanol, isopropanol, and ethylene glycol), dimethylformamide, tetrahydrofuran, cellosolves (e.g., methyl cellosolve), lower ketones (acetone and methyl ethyl ketone), and the like. The aqueous phase liquid can include a dispersant such as surfactants and polymeric protection colloids.

When a polyester prepolymer (A) having an isocyanate group (i.e., resin precursor) and an amine (B) are reacted to prepare toner particles, a method in which the polyester prepolymer (A) and the amine (B) are reacted in an aqueous phase liquid to prepare a modified polyester (i) (such as urea-modified polyester) and toner particles in the aqueous phase liquid, or a method in which the polyester prepolymer (A) and the amine (B) are reacted to prepare a modified polyester (i), and then the modified polyester is used for preparing toner particle, can be used.

In order to prepare a dispersion in which a modified polyester (i) or a combination of a polyester prepolymer (A) and an amine (B) is stably dispersed in an aqueous phase liquid, a method in which toner components including, for example, a modified polyester (i) or a combination of a polyester prepolymer (A) and an amine (B), another binder resin (such as a crystalline polyester), and a release agent are dispersed in an aqueous phase liquid upon application of shear force thereto can be preferably used.

When the toner components including a modified polyester (i) or a combination of a polyester prepolymer (A) and an amine (B), and other toner components (such as colorants (or colorant master batches), release agents, crystalline polyesters, unmodified polyesters and charge controlling agents) are added to an aqueous phase liquid, each of the toner components may be independently added to the aqueous phase liquid. However, it is preferable to add a mixture of all the toner components, which is previously prepared, to the aqueous phase liquid.

When optional toner components such as a colorant and a charge controlling agent are added, the components are not necessarily added together with the essential toner components such as a binder resin and a release agent, and such optional toner components may be mixed with the resultant toner particles. For example, a method in which after toner particles including no colorant are formed, the toner particles are dyed with a dye by a known dyeing method can also be used.

Known dispersing machines can be used for dispersing or emulsifying the toner components in an aqueous phase liquid. Suitable dispersing machines include low speed shear dispersion machines, high speed shear dispersion machines, friction dispersion machines, high pressure jet dispersion machines, ultrasonic dispersion machines, and the like.

When high speed shear dispersion machines are used, the revolution of the rotor is not particularly limited, but the revolution is generally from 1,000 rpm to 30,000 rpm, and preferably from 5,000 rpm to 20,000 rpm. The dispersion time is not particularly limited, but when a batch dispersion machine is used, the dispersion time is generally from 0.1 minutes to 5 minutes. The dispersion temperature is preferably from 0° C. to 150° C. and preferably from 40° C. to 98° C. It is preferable that the dispersion temperature is relatively high, because the resultant oil phase liquid including toner components such as a urea-modified polyester (i.e., modified polyester (i)) or a combination of a polyester prepolymer (A) and an amine (B) has a relatively low viscosity, and therefore the oil phase liquid can be easily dispersed in an aqueous phase liquid.

The added amount of the aqueous phase liquid is generally from 50 to 2,000 parts by weight, and preferably from 100 to 1,000 parts by weight, based on 100 parts by weight of the toner components including a modified polyester (i) or a combination of a polyester prepolymer (A) and an amine (B). When the added amount of the aqueous medium is not lower than 50 parts by weight, the toner components can be satisfactorily dispersed, and therefore toner particles having a desired particle diameter can be prepared. Adding too large an amount of aqueous phase liquid is not economical.

As mentioned above, a dispersant can be used for dispersing toner components in an aqueous phase liquid, if desired. By using a dispersant, the particle diameter distribution of the resultant dispersion (emulsion) becomes sharp, and the dispersion has good stability.

In a process in which a polyester prepolymer (A) and an amine (B) are reacted in an aqueous phase liquid to synthesize a urea-modified polyester (i.e., modified polyester (i)), a method in which after the amine is added to the aqueous phase liquid, the oil phase liquid including the polyester prepolymer is added thereto to be reacted with the amine, or a method in which after the oil phase liquid including the polyester prepolymer is added to the aqueous phase liquid, the amine is added thereto to be reacted with the polyester prepolymer (the reaction is started from the interface therebetween), can be used. In the latter case, the urea-modified polyester is formed in priority at the surface of the toner particles, and therefore concentration gradient of the urea-modified polyester can be formed in the depth direction of the toner particles.

When the oil phase liquid including the toner components is emulsified or dispersed in the aqueous phase liquid, a surfactant can be used as a dispersant.

Specific examples of the surfactant include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives, and polyhydric alcohol derivatives; and ampholytic surfactants such as alanine, dodecyldi(aminoethyl)glycin, di)octylaminoethyle)glycin, and N-alkyl-N,N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkyl(C7-C13) carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such surfactants include SARFRON S-111, S-112 and S-113, which are manufactured by Asahi Glass Co., Ltd.; FLUORAD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants having a fluoroalkyl group include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc. Specific examples of the marketed products thereof include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

In addition, inorganic compounds can also be used as a dispersant. Specific examples of the inorganic compounds include tricalcium phosphate, calcium carbonate, titanium oxide, colloidal silica, and hydroxyapatite.

Further, it is preferable to stabilize the emulsion or dispersion using a polymeric protection colloid.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When a dispersant such as calcium phosphate, which can be dissolved in an acid or an alkali, is used, it is preferable to dissolve the dispersant with hydrochloric acid to remove the dispersant from the toner particles, followed by washing the toner particles. In addition, it is possible to remove such a dispersant by decomposing the dispersant using an enzyme. When a dispersant is used for preparing toner particles, it is possible not to remove the dispersant after a reaction such as a polymer chain growth reaction and/or a crosslinking reaction, but it is preferable to remove the dispersant by washing the resultant toner particles to impart good charging property to the toner particles.

In order to reduce the viscosity of the oil phase liquid including the toner components, solvents capable of dissolving the binder resin or precursor thereof such as a modified polyester (i) and a prepolymer (A) can be used for the oil phase liquid. The solvent is preferably a volatile solvent having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio (S/P) of the solvent (S) to the polyester prepolymer (P) is generally from 0/100 to 300/100, preferably from 0/100 to 100/100 and more preferably from 25/100 to 70/100.

When such a solvent is used, the solvent is removed after the reaction such as a polymer chain growth reaction and/or a crosslinking reaction by heating the reaction product under normal or reduced pressure.

The reaction time of the polymer chain growth reaction and/or cros slinking reaction of the polyester prepolymer (A) is determined depending on the reactivity of the isocyanate group of the polyester prepolymer with the amine used, and is generally from 10 minutes to 40 hours, and preferably from 2 to 24 hours. The reaction temperature is generally from 0° C. to 150° C., and preferably from 40° C. to 98° C.

In addition, known catalysts such as dibutyltin laurate and tioctyltin layrate can be used for the reaction, if desired.

In order to remove an organic solvent from the emulsion prepared by emulsifying the oil phase liquid in the aqueous phase liquid, a method in which the emulsion is gradually heated to perfectly evaporate the organic solvent included in the emulsion can be used. Alternatively, a method in which the emulsion is sprayed in a dry environment to dry the organic solvent in the drops of the oil phase liquid (and water in the emulsion) can also be used. Specific examples of the dry environment include gases of air, nitrogen, carbon dioxide, combustion gas, etc., which are preferably heated to a temperature not lower than the boiling point of the solvent having the highest boiling point among the solvents included in the emulsion. Toner particles having desired properties can be rapidly prepared by performing this treatment using a spray dryer, a belt dryer, a rotary kiln, or the like.

When the emulsion has a wide particle diameter and therefore the resultant toner particles have a wide particle diameter distribution even after the particles are subjected to a washing treatment and a drying treatment, the toner particles are preferably subjected to a classification treatment so as to have a desired particle diameter distribution. Specific examples of the classifier include cyclones, decanters and classifiers utilizing centrifuge, in which fine and coarse particles are removed from the toner particles in the resultant dispersion. In this case, it is preferable to perform the classification operation in the liquid having the particles in view of efficiency, although it is possible to subject the dried toner particles to a classification treatment. Toner particles having a particle diameter falling out of the predetermined range can be reused for the emulsification/dispersion process or the kneading process in which toner components are kneaded before dispersed in an aqueous phase liquid. In this regard, the dispersant used for preparing the emulsion/dispersion is preferably removed from the toner particles, and it is preferable to perform the dispersant removing operation together with the classification treatment mentioned above.

The thus prepared toner particles can be mixed with one or more other particulate materials (external additives) such as colorants, release agents, charge controlling agents, and fluidizers. In this regard, mechanical impact can be applied thereto to fix the particulate materials on the surface of the toner particles, resulting in formation of a toner (i.e., complex particles).

Suitable mechanical impact application methods include methods in which a mixture is mixed with a highly rotated blade, and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The thus prepared toner can be used as a magnetic or non-magnetic one component developer including no carrier. When the thus prepared toner is used for a two-component developer, the toner is mixed with a magnetic carrier. The mixing ratio (T/C) of the toner (T) to the carrier (C) is preferably from 1/100 to 10/100.

Suitable materials for use as the carrier include known carrier materials such as iron powders, ferrite powders, magnetite powders, and magnetic resin carriers, which preferably have a particle diameter of from about 20 μm to about 200 μm. The surface of the carriers may be coated with a resin.

Specific examples of such resins for use as a cover layer of the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, polyester resins such as polyethyleneterephthalate resins and polybutyleneterephthalate resins, polycarbonate resins, polyethylene resins, halogenated olefin resins such as polyvinyl chloride resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, and copolymers of tetrafluoroethylene, vinylidenefluoride and other monomers including no fluorine atom, and silicone resins.

If desired, an electroconductive powder may be included in the cover layer. Specific examples of such electroconductive powders include metal powders, carbon blacks, titanium oxide, tin oxide, and zinc oxide. The average particle diameter of such electroconductive powders is preferably not greater than 1 μm so that the resistance of the resultant carrier can be satisfactorily controlled.

Thus, in the present invention, the toner mentioned above is used while the fixing belt 92 of the image forming apparatus 100 has the specific structure mentioned above. Therefore, the toner can efficiently catch heat from the fixing belt, and a release agent such as wax in particles of the toner can exude from the inside of the toner particles, thereby improving the releasability of the surface of a toner image, resulting in prevention of occurrence of the uneven glossiness problem. Since the temperature of the fixing belt 92 is detected by a temperature detector 86, which is set at such a position as to be opposed to the heat roller 91, the temperature of the fixing belt 92 can be measured with precision, thereby enhancing the uneven glossiness problem preventing effect.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Toner Preparation Example 1

Preparation of Particulate Resin Dispersion (1)

In a reaction vessel equipped with a stirrer and a thermometer, 700 parts of water, 12 parts of a sodium salt of sulfate of an ethylene oxide adduct of methacrylic acid (ELEMINOL RS-30 from Sanyo Chemical Industries Ltd.), 140 parts of styrene, 140 parts of methacrylic acid, and 1.5 parts of ammonium persulfate were mixed. The mixture was agitated for 20 minutes by rotating the stirrer at a revolution of 450 rpm. As a result, a milky emulsion was prepared. The emulsion was then heated for 5 hours at 75° C. to react the monomers. Further, 35 parts of a 1% aqueous solution of ammonium persulfate was added thereto, and the mixture was heated for 5 hours at 75° C. Thus, an aqueous dispersion of a vinyl resin (i.e., a copolymer of styrene/methacrylic acid/a sodium salt of sulfate of ethylene oxide adduct of methacrylic acid) was prepared. This dispersion is hereinafter referred to as a particulate resin dispersion (1).

The volume average particle diameter of the particles in the particulate resin dispersion (1), which was measured with an instrument LA-920 from Horiba Ltd., was 0.30 μm. In addition, when part of the particulate resin dispersion (1) was dried to prepare a solid material of the vinyl resin to measure the glass transition temperature of the solid vinyl resin, the glass transition temperature of vinyl resin was 155° C.

Preparation of Aqueous Phase Liquid (1)

In a reaction vessel equipped with a stirrer, 1,000 parts of water, 85 parts of the particulate resin dispersion (1) prepared above, 40 parts of an aqueous solution of a sodium salt of dodecyldiphenyletherdisulfonic acid (ELEMINOL MON-7 from Sanyo Chemical Industries Ltd., solid content of 50%), and 95 parts of ethyl acetate were mixed while agitated. As a result, a milky liquid was prepared. This liquid is hereinafter referred to as an aqueous phase liquid (1).

Preparation of Unmodified Polyester Resin (1)

The following components were contained in a reaction container equipped with a condenser, a stirrer and a nitrogen feed pipe.

| | |
|---|---|
| Ethylene oxide (2 mole) adduct of bisphenol A | 235 parts |
| Propylene oxide (3 mole) adduct of bisphenol A | 535 parts |
| Terephthalic acid | 215 parts |
| Adipic acid | 50 parts |
| Dibutyltin oxide | 3 parts |

The mixture was subjected to a polycondensation reaction for 10 hours at 240° C. under normal pressure, followed by a reaction for 6 hours under a reduced pressure of from 10 mmHg to 20 mmHg (i.e., 1.3 Pa to 2.7 Pa).

Further, 45 parts of trimellitic anhydride was fed to the container to be reacted with the reaction product for 3 hours at 185° C. Thus, an unmodified polyester resin (1) was prepared. The unmodified polyester resin (1) had a number average molecular weight of 2,800, a weight average molecular weight of 7,100, a glass transition temperature (Tg) of 45° C. and an acid value of 22 mgKOH/g.

Synthesis of Polyester Prepolymer (1)

The following components were contained in a reaction vessel equipped with a condenser, a stirrer and a nitrogen feed pipe.

| | |
|---|---|
| Ethylene oxide (2 mole) adduct of bisphenol A | 700 parts |
| Propylene oxide (2 mole) adduct of bisphenol A | 85 parts |
| Terephthalic acid | 300 parts |
| Trimellitic anhydride | 25 parts |
| Dibutyl tin oxide | 3 parts |

The mixture was reacted for 10 hours at 240° C. under normal pressure. The reaction was further continued for 6 hours under a reduced pressure of from 10 mmHg to 20 mmHg (1.3 Pa to 2.7 Pa). Thus, an intermediate polyester resin (1) was prepared.

The intermediate polyester (1) had a number average molecular weight of 2,500, a weight average molecular weight of 10,000, a glass transition temperature (Tg) of 58° C., an acid value of 0.5 mgKOH/g and a hydroxyl value of 52 mgKOH/g.

In a reaction vessel equipped with a condenser, a stirrer and a nitrogen feed pipe, 400 parts of the intermediate polyester resin (1), 90 parts of isophorone diisocyanate, and 500 parts of ethyl acetate were mixed. The mixture was heated for 6 hours at 110° C. to perform a reaction. Thus, a polyester prepolymer (1) having an isocyanate group was prepared. The content of free isocyanate included in the polyester prepolymer (1) was 1.67% by weight.

Synthesis of Crystalline Polyester (1)

In a 5-litter four-necked flask equipped with a nitrogen feed pipe, a dewatering conduit, a stirrer and a thermo couple, 28 moles of 1,4-butanediol, 24 moles of fumaric acid, 1.80 moles of trimellitic anhydride, and 6.0 g of hydroquinone were mixed. The mixture was heated for 6 hours at 160° C. to perform a reaction, followed by a reaction for 1 hour at 200° C., and a further reaction for 1 hour at 200° C. under a pressure of 8.3 kPa. Thus, a crystalline polyester (1) was prepared. The crystalline polyester (1) had a melting point (i.e., DSC endothermic peak temperature) of 150° C., a number average molecular weight (Mn) of 800, and a weight average molecular weight (Mw) of 3,000.

Synthesis of Crystalline Polyester (2)

In a 5-litter four-necked flask equipped with a nitrogen feed pipe, a dewatering conduit, a stirrer and a thermo couple, 28 moles of 1,4-butanediol, 24 moles of fumaric acid, 1.80 moles of trimellitic anhydride, and 6.0 g of hydroquinone were mixed. The mixture was heated for 3 hours at 120° C. to perform a reaction, followed by a reaction for 0.5 hours at 180° C., and a further reaction for 0.5 hours at 180° C. under a pressure of 8.3 kPa. Thus, a crystalline polyester (2) was prepared. The crystalline polyester (2) had a melting point (i.e., DSC endothermic peak temperature) of 50° C., a number average molecular weight (Mn) of 500, and a weight average molecular weight (Mw) of 1,000.

Synthesis of Ketimine Compound (I)

In a reaction vessel equipped with a stirrer and a thermometer, 180 parts of isophorone diamine was mixed with 80 parts of methyl ethyl ketone, and the mixture was reacted for 6 hours at 50° C. to prepare a ketimine compound. The ketimine compound (I) had an amine value of 420 mgKOH/g.

Preparation of Master Batch (1)

The following components were mixed using a HENSCHEL MIXER from Mitsui Mining Co., Ltd.

| | |
|---|---|
| Water | 1,300 parts |
| Carbon black (PRINTEX 35 from Degussa A.G., having DBP absorption of 43 ml/100 mg, and pH of 9.5) | 550 parts |
| Polyester resin | 1,300 parts |

The mixture was kneaded for 45 minutes at 160° C. using a two roll mill. The kneaded mixture was cooled by rolling, followed by pulverizing using a pulverizer. Thus, a master batch (1) was prepared.

Preparation of Colorant/Wax Dispersion (1)

The following components were fed into a reaction vessel equipped with a stirrer and a thermometer.

| | |
|---|---|
| Unmodified polyester (1) | 400 parts |
| Microcrystalline wax (having an acid value of 0.1 mgKOH/g and a melting point of 65° C., and having 20 carbon atoms while including linear hydrocarbons in an amount of 70% by weight) | 100 parts |
| Charge controlling agent (salicylic acid metal complex, E-84 from Orient Chemical industries Co., Ltd.) | 20 parts |
| Ethyl acetate | 1,000 parts |

After the mixture was heated at 80° C. for 8 hours, the mixture was cooled to 24° C. over 1 hour. Next, 480 parts of the master batch (1) and 550 parts of ethyl acetate were added to the vessel, and the mixture was agitated for 1 hour to prepare a raw material dispersion (1).

Next, the raw material dispersion (1) was fed into a container to be subjected to a dispersing treatment using a bead mill (ULTRAVISCOMILL from Aimex Co., Ltd.) so that the carbon black and the wax are dispersed. The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 1,000 parts of 65% ethyl acetate solution of the unmodified polyester resin (1) was added to the dispersion. The mixture was subjected to the dispersing treatment mentioned above using the bead mill. The dispersing conditions were the same as those mentioned above except that the dispersing operation was performed once (i.e., one pass).

The thus prepared colorant/wax dispersion (1) had a solid content of 53% when the solid content was determined by heating the dispersion at 130° C. for 30 minutes.

Preparation of Colorant/Wax Dispersion (2)

The procedure for preparation of the colorant/wax dispersion (1) was repeated except that the microcrystalline wax was replaced with 100 parts of a pentaerythritol-based ester wax to prepare a colorant/wax dispersion (2).

Preparation of Colorant/Wax Dispersion (3)

The procedure for preparation of the colorant/wax dispersion (1) was repeated except that the microcrystalline wax was replaced with 100 parts of another microcrystalline wax, which has an acid value of 0.1 mgKOH/g and a melting point of 90° C., and has 80 carbon atoms while including linear hydrocarbons in an amount of 55% by weight, to prepare a colorant/wax dispersion (3).

Preparation of Colorant/Wax Dispersion (4)

The procedure for preparation of the colorant/wax dispersion (1) was repeated except that the microcrystalline wax was replaced with 100 parts of another microcrystalline wax, which has an acid value of 0.1 mgKOH/g and a melting point of 90° C., and has 85-carbon atoms while including linear hydrocarbons in an amount of 50% by weight, to prepare a colorant/wax dispersion (4).

Preparation of Colorant/Wax Dispersion (5)

The procedure for preparation of the colorant/wax dispersion (1) was repeated except that the microcrystalline wax was replaced with 100 parts of a natural carnauba wax to prepare a colorant/wax dispersion (5).

Preparation of Crystalline Polyester Dispersion (1)

The following component were fed into a 2-litter metal container.

| | |
|---|---|
| Crystalline polyester (1) prepared above | 110 g |
| Ethyl acetate | 450 g |

The mixture was heated to 80° C. to dissolve or disperse the polyester, and the solution or dispersion was rapidly cooled in ice water to prepare a resin dispersion. The resin dispersion was subjected to a dispersing treatment for 10 hours by a batch sand mill from Kanpe Hapio Co., Ltd., which uses 500 ml of glass beads with a diameter of 3 mm as a dispersing media. Thus, a crystalline polyester dispersion (1) including particles of the crystalline polyester (1), which have a volume average particle diameter of 0.4 μm, was prepared.

Preparation of Crystalline Polyester Dispersion (2)

The procedure for preparation of the crystalline polyester dispersion (1) was repeated except that the crystalline polyester (1) was replaced with 110 parts of the crystalline polyester (2) prepared above to prepare a crystalline polyester dispersion (2).

Example 1

Emulsification and Solvent Removal

Then the following components were mixed in a vessel.

| | |
|---|---|
| Colorant/wax dispersion (1) prepared above | 700 parts |
| Polyester prepolymer (1) prepared above | 120 parts |
| Crystalline polyester dispersion (1) prepared above | 80 parts |
| Ketimine compound (1) prepared above | 5 parts |

The components were mixed for 1 minute using a TK HOMOMIXER from Tokushu Kika Kogyo K.K., which was rotated at a revolution of 6,000 rpm. Thus, an oil phase liquid (1) (i.e., a toner component liquid) was prepared.

Next, 1,300 parts of the aqueous phase liquid (1) prepared above was added to the oil phase liquid (1) in a container, and the mixture was mixed for 20 minutes using a TK HOMOMIXER, which was rotated at a revolution of 13,000 rpm. Thus, an emulsion (1) was prepared.

The thus prepared emulsion (1) was fed into a container equipped with a stirrer and a thermometer, and the emulsion was heated for 10 hours at 30° C. to remove the organic solvent (ethyl acetate) from the emulsion, followed by aging for 5 hours at 45° C. Thus, a dispersion (1) was prepared.

Washing and Drying

One hundred (100) parts of the dispersion (1) was filtered under a reduced pressure.

The wet cake was mixed with 100 parts of ion-exchange water, and the mixture was agitated for 10 minutes with a TK HOMOMIXER, which was rotated at a revolution of 12,000 rpm, followed by filtering. Thus, a wet cake (a) was prepared.

The thus prepared wet cake (a) was mixed with 100 parts of a 10% aqueous solution of sodium hydroxide, and the mixture was agitated for 10 minutes with a TK HOMOMIXER, which was rotated at a revolution of 12,000 rpm, followed by filtering under a reduced pressure. Thus, a wet cake (b) was prepared.

The thus prepared wet cake (b) was mixed with 100 parts of a 10% hydrochloric acid, and the mixture was agitated for 10 minutes with a TK HOMOMIXER, which was rotated at a revolution of 12,000 rpm, followed by filtering. Thus, a wet cake (c) was prepared.

Then the wet cake (c) was mixed with 300 parts of ion-exchange water and the mixture was agitated for 10 minutes with a TK HOMOMIXER, which was rotated at a revolution of 12,000 rpm, followed by filtering. This operation was repeated twice. Thus, a wet cake (1) was prepared.

The wet cake (1) was dried for 48 hours at 45° C. using a circulating air drier, followed by filtering using a screen having openings of 75 μm.

Thus, a mother toner (1) (i.e., toner particles without an external additive) was prepared.

Addition of External Additives

The following components were mixed using a HENSCHEL MIXER.

| | |
|---|---|
| Mother toner (1) prepared above | 100 parts |
| Hydrophobized silica (number average primary particle diameter of 10 nm) | 0.4 parts |
| Hydrophobized titanium oxide (number average primary particle diameter of 15 nm) | 0.4 parts |

Thus, a toner of Example 1 was prepared. The toner had a volume average particle diameter of 6 μm, and a particle diameter ratio (V/N) of 1.25.

The evaluation of evenness of glossiness of images of the toner was performed under the following conditions.

System speed of image forming apparatus used for evaluating uneven glossiness of images: 1,700 mm/sec Thickness L1 of a silicone rubber layer serving as the rubber layer 92*b* of the fixing belt 92: 750 μm Thickness L2 of a fluorine-containing resin layer serving as the release layer 92*c* of the fixing belt 92: 20 μm Example 2

The procedure for preparation and evaluation of the toner of Example 1 was repeated except that the system speed was changed from 1,700 mm/sec to 400 mm/sec.

Example 3

The procedure for preparation and evaluation of the toner of Example 1 was repeated except that the thickness L1 of the silicone rubber layer was changed from 750 μm to 400 μm, and the thickness L2 of the fluorine-containing resin layer was changed from 20 μm to 2 μm.

Example 4

The procedure for preparation and evaluation of the toner of Example 1 was repeated except that the added amount of the crystalline polyester dispersion (1) was changed from 80 parts to 5 parts.

Example 5

The procedure for preparation and evaluation of the toner of Example 1 was repeated except that the colorant/wax dispersion (1) was replaced with the colorant/wax dispersion (2).

Example 6

The procedure for preparation and evaluation of the toner of Example 1 was repeated except that the colorant/wax dispersion (1) was replaced with the colorant/wax dispersion (3).

Example 7

The procedure for preparation and evaluation of the toner of Example 1 was repeated except that the added amount of the colorant/wax dispersion (1) was changed from 700 parts to 35 parts.

Example 8

The procedure for preparation and evaluation of the toner of Example 1 was repeated except that the crystalline polyester dispersion (1) was replaced with the crystalline polyester dispersion (2).

Example 9

The procedure for preparation and evaluation of the toner of Example 1 was repeated except that the volume average particle diameter of the toner was changed from 6 μm to 3 μm, and the particle diameter ratio (V/N) was changed from 1.25 to 1.05.

Example 10

The procedure for preparation and evaluation of the toner of Example 1 was repeated except that the external additives were changed to the following.

| | |
|---|---|
| Hydrophobized silica mentioned above (number average primary particle diameter of 10 nm) | 1.2 parts |
| Hydrophobized large silica (number average primary particle diameter of 120 nm) | 3.0 parts |
| Hydrophobized titanium oxide mentioned above (number average primary particle diameter of 15 nm) | 0.8 parts |

Comparative Example 1

The procedure for preparation and evaluation of the toner of Example 1 was repeated except that the added amount of the crystalline polyester dispersion (1) was changed from 80 parts to 4 parts.

Comparative Example 2

The procedure for preparation and evaluation of the toner of Example 1 was repeated except that the thickness L1 of the silicone rubber layer was changed from 750 μm to 380 μm, and the thickness L2 of the fluorine-containing resin layer was changed from 20 μm to 25 μm.

Comparative Example 3

The procedure for preparation and evaluation of the toner of Example 1 was repeated except that the thickness L1 of the silicone rubber layer was changed from 750 μm to 800 μm, and the thickness L2 of the fluorine-containing resin layer was changed from 20 μm to 1 μm.

Comparative Example 4

The procedure for preparation and evaluation of the toner of Example 1 was repeated except that the colorant/wax dispersion (1) was replaced with the colorant/wax dispersion (4).

Comparative Example 5

The procedure for preparation and evaluation of the toner of Example 1 was repeated except that the colorant/wax dispersion (1) was replaced with the colorant/wax dispersion (5).

Next, 10 parts of each of the toners prepared above was mixed with 90 parts of a copper-zinc ferrite carrier, which is covered with a silicone resin and has an average particle diameter of 40 μm, under the following conditions to prepare two component developers.

Mixer used: TURBULA shaker mixer from Shinmaru Enterprises Corp.

Revolution: 71 rpm

Mixing time: 5 minutes

The evaluation items and evaluation methods are as follows.

1. Melting Points of Release Agent and Crystalline Polyester Included in Toner

The melting point of a release agent was determined as the temperature at a maximum endothermic peak in a DSC curve obtained by subjecting the release agent to differential scanning calorimetry (DSC). The melting point of a crystalline polyester was also determined by the same method.

2. W/R Ratio of Toner

Each of the toners was subjected to Fourier transform infrared spectroscopy (FT-IR) using an instrument AVATAR 370 from Thermo Electron Corporation and a KBr pellet method (i.e., total transmittance method) to obtain the infrared absorption spectra of the crystalline polyester and amorphous polyester therein.

The infrared absorption spectrum of a material is obtained by plotting the wavenumbers of infrared rays irradiated on the horizontal axis while plotting the absorbance of the material on the vertical axis, and the structure of the material can be determined from the spectrum.

FIG. 3 illustrates FT-IR absorption spectra of a crystalline polyester obtained when a toner of the present invention is subjected to FT-IR several times. As illustrated in FIG. 3, the FT-IR absorption spectrum specific to a crystalline polyester is characterized in that a falling peak (hereinafter referred to as a third falling peak Fp3) is present between a first falling peak Fp1 having a minimum absorbance, and a second falling peak Fp2 having the second lowest absorbance. As illustrated in FIG. 3, the height W of the third falling peak Fp3 is defined as the height from a base line obtained by connecting the first and second falling peaks Fp1 and Fp2.

Figure 4:
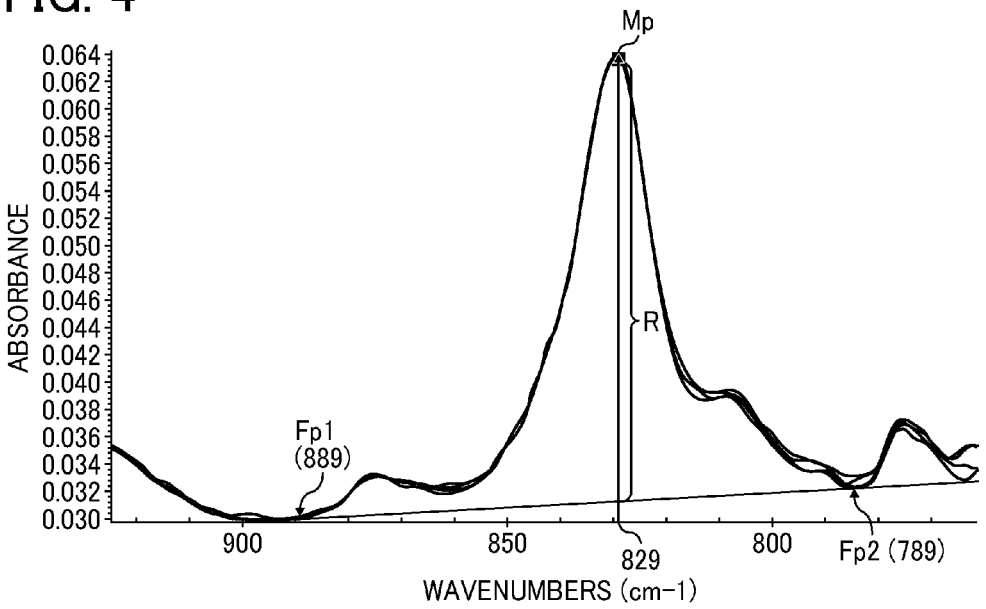
FIG. 4 is a graph illustrating FT-IR spectra of an amorphous polyester resin included in the example of the toner of the present invention when the toner is subjected to FT-IR several times.

FIG. 4 illustrates FT-IR absorption spectra specific to an amorphous polyester obtained when the toner is subjected to FT-IR several times. As illustrated in FIG. 4, the FT-IR absorption spectrum of an amorphous polyester is characterized in that a maximum rising peak Mp is much higher than the other rising peaks. As illustrated in FIG. 4, the height R of the maximum rising peak Mp is defined as the height from a base line obtained by connecting the first and second falling peaks Fp1 and Fp2.

The peak ratio (W/R) is determined from the height (W) of the third falling peak Fp3 specific to the crystalline polyester used for a toner and the height (R) of the maximum rising peak Mp specific to the amorphous polyester used for the toner.

3. Evenness of Glossiness of Toner Image

Each of the two-component developers was set in a printer, PRO C901 from Ricoh Co., Ltd., whose fixing unit was modified so as to have such a structure as illustrated in FIG. 1.

The system speed of the printer was measured by feeding one hundred (100) A-4-size sheets in such a manner that the longer sides of the sheets having a length of 297 mm are parallel to the feeding direction. The system speed B was determined by the following equation:

$$B(\text{mm/sec})=(100\times 297)/A,$$

wherein A represents the time (in units of seconds) taken for feeding the 100 sheets.

Next, 50,000 copies of an A-3-size original image having an image area proportion of 6% were produced using the printer. Thereafter, a one-dot line image was formed on three A-3-size paper sheets to compare the line images with a reference line image to evaluate the evenness of glossiness of the images. The evenness of glossiness of the images was graded as follows.

◎: The line images have excellent glossiness evenness.

○: The line images have good glossiness evenness.

Δ: The line images have slightly bad glossiness evenness.

X: The line images have bad glossiness evenness.

The evaluation results are shown in Tables 1-1 to 1-3 below.

TABLE 1-1

| | Example 1 | Example 2 | Example 3 | Example 4 | Example 5 |
|---|---|---|---|---|---|
| System speed (mm/sec) | 1,700 | 400 | 1,700 | 1,700 | 1,700 |
| L1 (μm) | 750 | 750 | 400 | 750 | 750 |
| L2 (μm) | 20 | 20 | 2 | 20 | 20 |
| W/R | 0.85 | 0.85 | 0.85 | 0.045 | 0.85 |
| Added amount of external additives (parts by weight) | 0.80 | 0.80 | 0.80 | 0.80 | 0.80 |
| Number of carbon atoms of wax | 20 | 20 | 20 | 20 | — |
| Content of linear hydro-carbons in wax (%) | 70 | 70 | 70 | 70 | — |
| DSC endothermic peak temp. of wax (° C.) | 65 | 65 | 65 | 65 | — |
| Content of wax in toner (% by weight) | 20 | 20 | 20 | 20 | 20 |
| DSC endothermic peak temp. of crystalline polyester (° C.) | 150 | 150 | 150 | 150 | 150 |
| Volume average particle diameter of toner (μm) | 6 | 6 | 6 | 6 | 6 |
| Particle diameter ratio of toner | 1.25 | 1.25 | 1.25 | 1.25 | 1.25 |
| Evenness of glossiness of image | ○ | ◎ | ◎ | ○ | ◎ |

TABLE 1-2

| | Example 6 | Example 7 | Example 8 | Example 9 | Example 10 |
|---|---|---|---|---|---|
| System speed (mm/sec) | 1,700 | 1,700 | 1,700 | 1,700 | 1,700 |
| L1 (μm) | 750 | 750 | 750 | 750 | 750 |
| L2 (μm) | 20 | 20 | 20 | 20 | 20 |
| W/R | 0.85 | 0.85 | 0.85 | 0.85 | 0.85 |
| Added amount of external additives (parts by weight) | 0.80 | 0.80 | 0.80 | 0.80 | 5.00 |
| Number of carbon atoms of wax | 80 | 20 | 20 | 20 | 20 |
| Content of linear hydro-carbons in wax (%) | 55 | 70 | 70 | 70 | 70 |
| DSC endothermic peak temp. of wax (° C.) | 90 | 65 | 65 | 65 | 65 |

TABLE 1-2-continued

| | Example 6 | Example 7 | Example 8 | Example 9 | Example 10 |
|---|---|---|---|---|---|
| Content of wax in toner (% by weight) | 20 | 1 | 20 | 20 | 20 |
| DSC endothermic peak temp. of crystalline polyester (° C.) | 150 | 150 | 50 | 150 | 150 |
| Volume average particle diameter of toner (μm) | 6 | 6 | 6 | 3 | 6 |
| Particle diameter ratio of toner | 1.25 | 1.25 | 1.25 | 1.05 | 1.25 |
| Evenness of glossiness of image | ○ | ○ | ◎ | ○ | ○ |

TABLE 1-3

| | Comp. Example 1 | Comp. Example 2 | Comp. Example 3 | Comp. Example 4 | Comp. Example 5 |
|---|---|---|---|---|---|
| System speed (mm/sec) | 1,700 | 1,700 | 1,700 | 1,700 | 1,700 |
| L1 (μm) | 750 | 380 | 800 | 750 | 750 |
| L2 (μm) | 20 | 25 | 1 | 20 | 20 |
| W/R | 0.043 | 0.85 | 0.85 | 0.045 | 0.85 |
| Added amount of external additives (parts by weight) | 0.80 | 0.80 | 0.80 | 0.80 | 0.80 |
| Number of carbon atoms of wax | 20 | 20 | 20 | 85 | — |
| Content of linear hydro-carbons in wax (%) | 70 | 70 | 70 | 50 | — |
| DSC endothermic peak temp. of wax (° C.) | 65 | 65 | 65 | 92 | — |
| Content of wax in toner (% by weight) | 20 | 20 | 20 | 20 | 20 |
| DSC endothermic peak temp. of crystalline polyester (° C.) | 150 | 150 | 150 | 150 | 150 |
| Volume average particle diameter of toner (μm) | 6 | 6 | 6 | 6 | 6 |
| Particle diameter ratio of toner | 1.25 | 1.25 | 1.25 | 1.25 | 1.25 |
| Evenness of glossiness of image | X | X | X | X | X |

It is clear from Tables 1-1 to 1-3 that the images produced by the combinations of the toners of Examples 1-10 and the fixing device mentioned above have good or excellent glossiness evenness even when the images are produced at a high system speed of from 400 to 1,700 mm/sec.

The present invention can be applied not only to such a tandem image forming apparatus as illustrated in FIG. 1, but also to a one-drum image forming apparatus in which color toner images are sequentially formed on one photoreceptor drum, and the color toner images are transferred onto a recording material or in which a monochrome toner image is formed on one photoreceptor drum, and the toner image is transferred onto a recording material. In addition, these image forming apparatuses can optionally use an intermediate transfer medium to transfer toner images from the photoreceptors to the recording material.

Additional modifications and variations of the present invention are possible in light of the above teachings. It is therefore to be understood that within the scope of the appended claims the invention may be practiced other than as specifically described herein.

What is claimed is:

1. An image forming apparatus comprising:

an image forming device to form an image of a toner on a recording material; and a fixing device including an endless fixing belt to bear the toner image thereon;

a controller configured to control a speed of the fixing device to feed the recording material from 400 to 1,700 mm/sec while heating the recording material to fix the toner image on the recording material, wherein the fixing belt has at least a substrate, a rubber layer located on the substrate and having a thickness of from 400 μm to 700 μm, and a fluorine-containing resin layer located on the rubber layer and having a thickness of from 2 μm to 20 μm, wherein the toner includes:

toner particles including:

a release agent including at least one of a microcrystalline wax and a synthetic ester wax; and a binder resin including a crystalline polyester resin having a long axis diameter of from 0.2 μm to 0.3 μm and an amorphous polyester resin in a surface portion of the toner particles that envelopes the release agent, and wherein an amount of the crystalline polyester resin and an amount of the amorphous polyester resin in a surface portion of the toner particles satisfies the following relation:

$$0.045 \leq W/R \leq 0.850,$$

wherein W represents a height of a third falling peak specific to the crystalline polyester resin in a Fourier transform infrared spectroscopy (FT-IR) spectrum obtained by subjecting the toner to FT-IR using a KBr pellet method, and R represents a height of a maximum rising peak specific to the amorphous polyester resin in the FT-IR spectrum.

2. The image forming apparatus according to claim 1, wherein the release agent includes a microcrystalline wax having a DSC endothermic peak of from 65° C. to 90° C. and including hydrocarbons, which have 20 to 80 carbon atoms and include linear hydrocarbons in an amount of from 55% to 70% by weight.

3. The image forming apparatus according to claim 1, wherein the release agent includes a synthetic monoester wax obtained from a saturated linear fatty acid and a saturated linear alcohol.

4. The image forming apparatus according to claim 1, wherein the toner particles include the release agent in an amount of from 1% to 20% by weight based on a weight of the toner particles.

5. The image forming apparatus according to claim 1, wherein the crystalline polyester resin has a DSC endothermic peak in a temperature range of from 50° C. to 150° C.

6. The image forming apparatus according to claim 1, wherein the toner particles have a volume average particle diameter of from 3.0 μm to 6.0μm.

7. The image forming apparatus according to claim 1, wherein the toner particles have a particle diameter ratio of from 1.05 to 1.25, wherein the particle diameter ratio is defined as a ratio (V/N) of a volume average particle diameter (V) of the toner particles to a number average particle diameter (N) of the toner particles.

8. The image forming apparatus according to claim 1, wherein the toner is prepared by a method including:

preparing an oil phase liquid including at least the binder resin, a binder resin precursor, and an organic solvent, and optionally including the release agent;

dispersing the oil phase liquid in an aqueous medium to prepare an emulsion; and removing at least the organic solvent from the emulsion to prepare the toner particles.

9. The image forming apparatus according to claim 1, wherein the fixing device further includes:

a heat roller, which has a heater therein to heat the fixing belt looped around the heat roller;

a fixing roller around which the fixing belt is looped;

a pressure roller contacted with the fixing roller with the fixing belt therebetween to press the recording material bearing the toner image thereon toward the fixing belt; and a temperature detector to detect a temperature of a surface of the fixing belt.

10. The image forming apparatus according to claim 9, wherein the temperature detector is opposed to the heat roller with the fixing belt therebetween.

11. The image forming apparatus according to claim 1, wherein the image forming apparatus forms images on A-4 size recording material sheets at a speed of 70 sheets per minute.

12. The image forming apparatus according to claim 1, wherein the image forming device includes:

an image bearing member to bear the toner image thereon;

a charger to charge the image bearing member; and a cleaner having an elastic blade contacted with a surface of the image bearing member from a counter direction to clean the surface of the image bearing member.

13. An image forming method comprising:

forming an image of a toner on a recording material; and fixing the toner image on the recording material using the apparatus of claim 1.

14. The image forming apparatus according to claim 1, wherein the peak specific to the crystalline polyester resin used for determining W is a peak observed at 1165 $cm^{-1}$ whose base line is a line obtained by connecting a point at 1199 $cm^{-1}$ and a point at 1137 $cm^{-1}$ , and the peak specific to the amorphous polyester resin used for determining R is a peak observed at 829 $cm^{-1}$ whose base line is a line obtained by connecting a point at 784 $cm^{-1}$ and a point at 889 $cm^{-1}$.

* * * * *